US008783728B2

(12) United States Patent
Kaule et al.

(10) Patent No.: US 8,783,728 B2
(45) Date of Patent: Jul. 22, 2014

(54) ENDLESS MATERIAL FOR SECURITY ELEMENTS

(75) Inventors: Wittich Kaule, Emmering (DE); Wolfgang Rauscher, München (DE); Marius Dichtl, München (DE)

(73) Assignee: Giesecke & Devrient GmbH (DE)

( * ) Notice: Subject to any disclaimer, the term of this patent is extended or adjusted under 35 U.S.C. 154(b) by 870 days.

(21) Appl. No.: 12/601,590

(22) PCT Filed: May 27, 2008

(86) PCT No.: PCT/EP2008/004190

§ 371 (c)(1), (2), (4) Date: Nov. 24, 2009

(87) PCT Pub. No.: WO2008/145333

PCT Pub. Date: Dec. 4, 2008

(65) Prior Publication Data

US 2010/0187806 A1 Jul. 29, 2010

(30) Foreign Application Priority Data

Jun. 1, 2007 (DE) ..... 10 2007 025 667

(51) Int. Cl.

| | |
|---|---|
| ***B42D 15/00*** | (2006.01) |
| ***B42D 15/10*** | (2006.01) |
| ***B41F 19/06*** | (2006.01) |
| *B41M 3/14* | (2006.01) |

(52) U.S. Cl.

CPC ..... *B41F 19/062* (2013.01); *B42D 2035/28* (2013.01); *B41M 3/14* (2013.01); *B42D 15/002* (2013.01); *B42D 2035/44* (2013.01)

USPC ..... 283/67; 283/72; 283/88; 283/94; 283/98; 283/107; 283/108; 283/110; 283/114

(58) Field of Classification Search

USPC ..... 283/67, 72, 88, 94, 98, 107, 108, 110, 283/114

See application file for complete search history.

(56) References Cited

U.S. PATENT DOCUMENTS

| | | | | |
|---|---|---|---|---|
| 4,892,336 | A | 1/1990 | Kaule et al. | |
| 5,365,541 | A * | 11/1994 | Bullock | 372/99 |

(Continued)

FOREIGN PATENT DOCUMENTS

| | | | |
|---|---|---|---|
| DE | 19947397 | A1 | 5/2001 |
| DE | 10128264 | A1 | 12/2002 |
| DE | 102005028162 | A1 | 12/2006 |
| DE | 102005062132 | A1 | 7/2007 |

(Continued)

*Primary Examiner* — Shelley Self
*Assistant Examiner* — Justin V Lewis
(74) *Attorney, Agent, or Firm* — The Webb Law Firm

(57) ABSTRACT

An anti-counterfeit printed matter forming an invisible image that can be visualized clearly and prevents a visible image from impeding visibility of a visualized invisible image. In the anti-counterfeit printed matter according to this invention, a plurality of object elements are arranged at a predetermined pitch in a matrix, each object element including a first and second object arranged along a first direction on both sides of a boundary at a center, opposing each other, and third and fourth objects arranged along a second direction perpendicular to the first direction on both sides of a boundary at the center, opposing each other. The first object and the second object, and the third object and the fourth object of each object element have a negative/positive relationship. The first object and/or the second object forms a first invisible image. The third object and/or the fourth object forms a second invisible image.

66 Claims, 8 Drawing Sheets

(56) References Cited

U.S. PATENT DOCUMENTS

| | | | | |
|---|---|---|---|---|
| 5,544,584 | A * | 8/1996 | Thompson et al. | 101/401.1 |
| 5,712,731 | A * | 1/1998 | Drinkwater et al. | 359/619 |
| 6,502,510 | B1 | 1/2003 | Breiholdt | |
| 7,630,494 | B2 | 12/2009 | Luthi | |
| 8,041,107 | B2 * | 10/2011 | Kato et al. | 283/88 |
| 2003/0102662 | A1 * | 6/2003 | Stenzel et al. | 283/114 |
| 2003/0121984 | A1 * | 7/2003 | Pinchen et al. | 235/487 |
| 2005/0116464 | A1 * | 6/2005 | Isherwood et al. | 283/72 |
| 2009/0008923 | A1 | 1/2009 | Kaule et al. | |
| 2009/0297805 | A1 | 12/2009 | Dichtl | |

FOREIGN PATENT DOCUMENTS

| | | | |
|---|---|---|---|
| DE | 102006029852 | A1 | 1/2008 |
| EP | 0238043 | A2 | 9/1987 |
| EP | 0330033 | A2 | 8/1989 |
| EP | 0064067 | B2 | 3/2002 |
| EP | 1527901 | A1 | 5/2005 |
| EP | 1527902 | A2 | 5/2005 |
| GB | 2036649 | A | 7/1980 |
| WO | WO 8201595 | A1 | 5/1982 |
| WO | WO 2005036216 | A2 | 4/2005 |
| WO | WO 2007076952 | A2 | 7/2007 |

* cited by examiner

ENDLESS MATERIAL FOR SECURITY ELEMENTS

BACKGROUND OF THE INVENTION

1. Field of the Invention

The present invention relates to an endless material for security elements having micro-optical moiré magnification arrangements, and a method for manufacturing such an endless material.

2. Description of Related Art

For protection, data carriers, such as value or identification documents, but also other valuable articles, such as branded articles, are often provided with security elements that permit the authenticity of the data carrier to be verified, and that simultaneously serve as protection against unauthorized reproduction. The security elements can be developed, for example, in the form of a security thread embedded in a banknote, a cover foil for a banknote having a hole, an applied security strip or a self-supporting transfer element that, after its manufacture, is applied to a value document.

Here, security elements having optically variable elements that, at different viewing angles, convey to the viewer a different image impression play a special role, since these cannot be reproduced even with top-quality color copiers. For this, the security elements can be furnished with security features in the form of diffraction-optically effective micro- or nanostructures, such as with conventional embossed holograms or other hologram-like diffraction patterns, as are described, for example, in publications EP 0 330 33 A1 and EP 0 064 067 A1.

It is also known to use lens systems as security features. For example, in publication EP 0 238 043 A2 is described a security thread composed of a transparent material on whose surface a grating composed of multiple parallel cylindrical lenses is embossed. Here, the thickness of the security thread is chosen such that it corresponds approximately to the focal length of the cylindrical lenses. On the opposing surface, a printed image is applied in perfect register, the printed image being designed taking into account the optical properties of the cylindrical lenses. Due to the focusing effect of the cylindrical lenses and the position of the printed image in the focal plane, depending on the viewing angle, different sub-areas of the printed image are visible. In this way, through appropriate design of the printed image, pieces of information can be introduced that are, however, visible only from certain viewing angles. Through the appropriate development of the printed image, also "moving" pictures can be created. However, when the document is turned about an axis that runs parallel to the cylindrical lenses, the motif moves only approximately continuously from one location on the security thread to another location.

Also so-called moiré magnification arrangements have been in use for some time as security features. The fundamental operating principle of such moiré magnification arrangements is described in the article "The moiré magnifier," M. C. Hutley, R. Hunt, R. F. Stevens and P. Savander, Pure Appl. Opt. 3 (1994), pp. 133-142. In short, according to this article, moiré magnification refers to a phenomenon that occurs when a grid composed of identical image objects is viewed through a lens grid having approximately the same grid dimension. As with every pair of similar grids, a moiré pattern results, each of the moiré strips in this case appearing in the form of a magnified and/or rotated image of the repeated elements of the image grid.

In manufacturing such moiré magnification arrangements, normally an endless security element foil is first manufactured as roll material, wherein, when conventional manufacturing methods are used, breaking points always occur, especially gaps or a misalignment in the appearance of the security elements. These breaking points come from the fact that the pre-products for the embossing dies used in manufacturing are generally manufactured as flat plates that are fitted on an impression or embossing cylinder. The image patterns that adjoin on both sides normally do not match at the seams and lead to motif disturbances of the kind cited in the appearance of the finished security elements after printing or embossing.

SUMMARY OF THE INVENTION

Based on that, the object of the present invention is to avoid the disadvantages of the background art and especially to specify a method for producing security elements having micro-optical moiré magnification arrangements having motif images that are free of disturbances, as well as a corresponding endless material.

This object is solved by the method for manufacturing endless material for security elements having the features of the main claim. An endless material for security elements, a manufacturing method for security elements, methods for manufacturing impression or embossing cylinders, and impression or embossing cylinders manufactured accordingly are specified in the coordinated claims. Developments of the present invention are the subject of the dependent claims.

The present invention relates to a method for manufacturing endless material for security elements having micro-optical moiré magnification arrangements that exhibit a motif grid composed of a plurality of micromotif elements and a focusing element grid composed of a plurality of microfocusing elements for moiré-magnified viewing of the micromotif elements, in which a) a motif grid composed of an at least locally periodic arrangement of micromotif elements in the form of a first one- or two-dimensional lattice is provided,
b) a focusing element grid composed of an at least locally periodic arrangement of a plurality of microfocusing elements in the form of a second one- or two-dimensional lattice is provided,
c) a pattern repeat of the motif grid and/or of the focusing element grid on the endless material is specified,
d) it is checked whether the lattice of the motif grid and/or the lattice of the focusing element grid repeats periodically in the specified pattern repeat, and if this is not the case, a linear transformation is determined that distorts the first and/or the second lattice such that it repeats periodically in the specified pattern repeat, and
e) for the further manufacture of the endless material, the motif grid or the focusing element grid is replaced by the motif grid that is distorted by the determined linear transformation, or the focusing element grid that is distorted by the determined linear transformation.

The distortion according to the present invention can affect only the motif grid, only the focusing element grid or both grids. Depending on the specified grids, the motif grid and the focusing element grid can also require different distortions, as explained in greater detail below.

In this method is preferably specified, in step c), a pattern repeat q along the endless longitudinal direction of the endless material. The longitudinal pattern repeat q is especially given by the circumference of an embossing or impression cylinder for producing the motif grid and/or of the focusing element grid.

According to an advantageous method, in step d), a lattice point P of the first and/or the second lattice is selected that lies near the endpoint Q of the vector $$\begin{pmatrix} 0 \\ q \end{pmatrix}$$

given by the longitudinal pattern repeat, and a linear transformation V is determined that maps P to Q. Advantageously, as the lattice point lying near the endpoint Q, a lattice point P is chosen whose distance from Q along the lattice vector or both lattice vectors is, in each case, less than 10 lattice periods, preferably less than 5, particularly preferably less than 2 and especially less than one lattice period. Especially the lattice point closest to the endpoint Q can be chosen as the lattice point P.

The linear transformation V is expediently calculated using the relationship $$V = \begin{pmatrix} b_x & 0 \\ b_y & q \end{pmatrix} \cdot \begin{pmatrix} a_x & p_x \\ a_y & p_y \end{pmatrix}^{-1}$$

wherein $$\begin{pmatrix} p_x \\ p_y \end{pmatrix} \text{ and } \begin{pmatrix} 0 \\ q \end{pmatrix}$$

represent the coordinate vectors of the lattice point P and the endpoint Q, and $$\vec{b} = \begin{pmatrix} b_x \\ b_y \end{pmatrix} \text{ and } \vec{a} = \begin{pmatrix} a_x \\ a_y \end{pmatrix}$$

arbitrary vectors. Here, to obtain little-distorted lattices, the vectors $\vec{a}$ and $\vec{b}$ advantageously differ only a little, or are even identical, in magnitude and direction. According to a simple special case, the linear transformation V is calculated using the relationship $$V = \begin{pmatrix} 1 & 0 \\ 0 & q \end{pmatrix} \cdot \begin{pmatrix} 1 & p_x \\ 0 & p_y \end{pmatrix}^{-1} = \begin{pmatrix} 1 & -p_x/p_y \\ 0 & q/p_y \end{pmatrix}.$$

It can also happen that the closest lattice point P and the pattern repeat endpoint Q coincide, in other words $p_x=0$ and $p_y=q$. In this case, the transformation matrix V is the unit matrix, such that no adjustment transformation is required.

Furthermore, the case can also occur that the closest lattice point P and the pattern repeat endpoint Q in the y-direction (pattern repeat direction) lie in succession, so $p_x=0$ and $p_y \neq q$. In this case, instead of the adjustment of the moiré magnifier data, the pattern repeat length can also be adjusted, as described below.

In addition to specifying a longitudinal pattern repeat, in step c), a pattern repeat b along the transverse direction of the endless material can be specified. It can especially be provided that, in a later method step, the endless material is cut into parallel longitudinal strips, the transverse pattern repeat b being given by the width of these longitudinal strips. Then, expediently, in step d), a lattice point P of the first and/or the second lattice is selected that lies near the endpoint Q of the vector $$\begin{pmatrix} 0 \\ q \end{pmatrix}$$

given by the longitudinal pattern repeat, a lattice point A of the first and/or the second lattice is selected that lies near the endpoint B of the vector $$\begin{pmatrix} b \\ 0 \end{pmatrix}$$

given by the transverse pattern repeat, and a linear transformation V is determined that maps P to Q and A to B.

As the lattice points lying near the endpoints Q and B, preferably such lattice points P and A are chosen whose distances from Q and B along the lattice vector or both lattice vectors is, in each case, less than 10 lattice periods, preferably less than 5, particularly preferably less than 2 and especially less than one lattice period. In particular, the lattice point closest to the endpoint Q can be chosen as the lattice point P, and the lattice point closest to the endpoint B as the lattice point A.

The linear transformation V is advantageously calculated using the relationship $$V = \begin{pmatrix} b & 0 \\ 0 & q \end{pmatrix} \cdot \begin{pmatrix} a_x & p_x \\ a_y & p_y \end{pmatrix}^{-1}$$

wherein $$\begin{pmatrix} p_x \\ p_y \end{pmatrix} \text{ and } \begin{pmatrix} 0 \\ q \end{pmatrix}$$

represent the coordinate vectors of the lattice point P and the endpoint Q, and $$\begin{pmatrix} a_x \\ a_y \end{pmatrix} \text{ and } \begin{pmatrix} b \\ 0 \end{pmatrix}$$

the coordinate vectors of the lattice point A and the endpoint B.

Additionally or alternatively to the longitudinal pattern repeat, the transverse pattern repeat b can be specified. Also, instead of the specification of a pattern repeat in the longitudinal or transverse direction, the specification of a desired pattern repeat in one or two arbitrary directions may be considered. The required linear transformation for distorting the first and/or second lattice is determined analogously to the described approach.

As explained in detail below, the first and second lattice can each be one-dimensional translation lattices, for example cylindrical lenses as microfocusing elements and motifs extended arbitrarily in one direction as micromotif elements, or also two-dimensional Bravais lattices.

Here, in a preferred development of the manufacturing method, it is provided that a desired image that is visible when viewed and has one or more moiré image elements is defined, the arrangement of magnified moiré image elements being chosen in the form of a two-dimensional Bravais lattice whose lattice cells are given by vectors $\vec{t}_1$ and $\vec{t}_2$, the focusing element grid in step b) is provided as an arrangement of microfocusing elements in the form of a two-dimensional Bravais lattice whose lattice cells are given by vectors $\vec{w}_1$ and $\vec{w}_2$, and in step a), the motif grid having the micromotif elements is calculated using the relationships $$\overleftrightarrow{U} = \overleftrightarrow{W} \cdot (\overleftrightarrow{T} + \overleftrightarrow{W})^{-1} \cdot \overleftrightarrow{T}$$

$$\vec{r} = \overleftrightarrow{W} \cdot (\overleftrightarrow{T} + \overleftrightarrow{W})^{-1} \cdot \vec{R} + \vec{r}_0$$

wherein $$\vec{R} = \begin{pmatrix} X \\ Y \end{pmatrix}$$

represents an image point of the desired image, number $$\vec{r} = \begin{pmatrix} x \\ y \end{pmatrix}$$

an image point of the motif grid, $$\vec{r}_0 = \begin{pmatrix} x_0 \\ y_0 \end{pmatrix}$$

a displacement between the arrangement of microfocusing elements and the arrangement of micromotif elements, and the matrices $\overleftrightarrow{T}$, $\overleftrightarrow{W}$ and $\overleftrightarrow{U}$ are given by $$\overleftrightarrow{T} = \begin{pmatrix} t_{11} & t_{12} \\ t_{21} & t_{22} \end{pmatrix}, \overleftrightarrow{W} = \begin{pmatrix} w_{11} & w_{12} \\ w_{21} & w_{22} \end{pmatrix} \text{ and } \overleftrightarrow{U} = \begin{pmatrix} u_{11} & u_{12} \\ u_{21} & u_{22} \end{pmatrix},$$

with $t_{1i}$, $t_{2i}$, $u_{1i}$, $u_{2i}$ and $w_{1i}$, $w_{2i}$ representing the components of the lattice cell vectors $\overleftrightarrow{t}_i$, $\vec{u}_i$ and $\vec{w}_i$, where i=1, 2.

In another, likewise preferred development of the manufacturing method, it is provided that a desired image that is visible when viewed, having one or more moiré image elements, is defined, the focusing element grid in step b) is provided as an arrangement of microfocusing elements in the form of a two-dimensional Bravais lattice whose lattice cells are given by vectors $\vec{w}_1$ and $\vec{w}_2$, a desired movement of the visible image when the moiré magnification arrangement is tilted laterally and when tilted forward and back is defined, the desired movement being specified in the form of the matrix elements of a transformation matrix $\overleftrightarrow{A}$, and in step a), the motif grid having the micromotif elements is calculated using the relationships $$\overleftrightarrow{U} = (\overleftrightarrow{I} - \overleftrightarrow{A}^{-1}) \cdot \overleftrightarrow{W}$$

and $$\vec{r} = \overleftrightarrow{A}^{-1} \cdot \vec{R} + \vec{r}_0,$$

$$\vec{R} = \begin{pmatrix} X \\ Y \end{pmatrix}$$

representing an image point of the desired image, $$\vec{r} = \begin{pmatrix} x \\ y \end{pmatrix}$$

an image point of the motif image, $$\vec{r}_0 = \begin{pmatrix} x_0 \\ y_0 \end{pmatrix}$$

a displacement between the arrangement of microfocusing elements and the arrangement of micromotif elements, and the matrices $\overleftrightarrow{A}$, $\overleftrightarrow{W}$ and $\overleftrightarrow{U}$ being given by $$\overleftrightarrow{A} = \begin{pmatrix} a_{11} & a_{12} \\ a_{21} & a_{22} \end{pmatrix}, \overleftrightarrow{W} = \begin{pmatrix} w_{11} & w_{12} \\ w_{21} & w_{22} \end{pmatrix} \text{ and } \overleftrightarrow{U} = \begin{pmatrix} u_{11} & u_{12} \\ u_{21} & u_{22} \end{pmatrix},$$

with $u_{1i}$, $u_{2i}$ and $w_{1i}$, $w_{2i}$ representing the components of the lattice cell vectors $\vec{u}_i$ and $\vec{w}_i$, where i=1, 2.

In both cited variants, the vectors $\vec{u}_1$ and $\vec{u}_2$, and $\vec{w}_1$ and $\vec{w}_2$ can be modulated location dependently, the local period parameters $|\vec{u}_1|$, $|\vec{u}_2|$, $\angle(\vec{u}_1, \vec{u}_2)$ and $|\vec{w}_1|$, $|\vec{w}_2|$, $\angle(\vec{w}_1, \vec{w}_2)$ changing only slowly in relation to the periodicity length.

The motif grid and the focusing element grid are expediently arranged at opposing surfaces of an optical spacing layer. The spacing layer can comprise, for example, a plastic foil and/or a lacquer layer.

In an advantageous embodiment of the method, step e) comprises providing an impression or embossing cylinder with the distorted focusing element grid. In particular, in step e), a flat plate can be provided with the distorted focusing element grid, and the flat plate or a flat casting of the plate can be fitted on an impression or embossing cylinder such that a cylinder having seams is created having a cylinder circumference q. Alternatively, in step e), a coated cylinder having a cylinder circumference q can be provided with the distorted focusing element grid through a material-ablation process, especially through laser ablation.

The method step e) advantageously comprises embossing the distorted focusing element grid in an embossable lacquer layer, especially in a thermoplastic lacquer or UV lacquer that is arranged on the front of an optical spacing layer.

In a further advantageous embodiment of the method, step e) comprises providing an impression or embossing cylinder with the distorted motif grid. In particular, in step e), a flat plate can be provided with the distorted motif grid, and the flat plate or a flat casting of the plate can be fitted on an impression or embossing cylinder such that a cylinder having seams is created having a cylinder circumference q. Alternatively, in step e), a coated cylinder having a cylinder circumference q can be provided with the distorted motif grid through a material-ablation process, especially through laser ablation.

The method step e) advantageously also comprises the embossing of the distorted motif grid in an embossable lacquer layer, especially in a thermoplastic lacquer or UV lacquer that is arranged on the reverse of an optical spacing layer. In another method variant, step e) comprises imprinting the distorted motif grid on a substrate layer, especially on the reverse of an optical spacing layer.

According to an alternative manufacturing method for endless material for security elements having micro-optical moiré magnification arrangements that exhibit a motif grid composed of a plurality of micromotif elements and a focusing element grid composed of a plurality of microfocusing elements for moiré-magnified viewing of the micromotif elements, it is provided that a) a motif grid composed of an at least locally periodic arrangement of micromotif elements in the form of a first one- or two-dimensional lattice is provided,
b) a focusing element grid composed of an at least locally periodic arrangement of a plurality of microfocusing elements in the form of a second one- or two-dimensional lattice is provided,
c) a pattern repeat of the motif grid and/or of the focusing element grid on the endless material is specified,
d) it is checked whether the lattice of the motif grid and/or the lattice of the focusing element grid repeats periodically in the specified pattern repeat, and if this is not the case, the pattern repeat length for the motif grid and/or for the focusing element grid is changed such that the first and/or the second lattice repeats periodically in the changed pattern repeat, and
e) for the further manufacture of the endless material, the specified pattern repeat is replaced by the changed pattern repeat.

Also in this method variant, in step c) is advantageously specified a pattern repeat q along the endless longitudinal direction of the endless material and/or a pattern repeat b along the transverse direction of the endless material.

The present invention also relates to an endless material for security elements for security papers, value documents and the like, that is manufacturable especially according to an above-described method, and that exhibits micro-optical moiré magnification arrangements that are arranged free of motif disturbances on a length of 10 meters or more, especially free of seams, gaps or misalignments. The micro-optical moiré magnification arrangements are preferably even arranged free of motif disturbances on a length of 100 meters or more, on a length of 1,000 meters or more, or even on a length of 10,000 meters or more.

The micro-optical moiré magnification arrangements are advantageously arranged on the endless material, free of motif disturbances, with a specified pattern repeat, especially along the endless longitudinal direction of the endless material with a pattern repeat q and/or along the transverse direction of the endless material with a pattern repeat b.

The present invention further relates to an endless material for security elements for security papers, value documents and the like that is manufacturable in the described manner and that includes micro-optical moiré magnification arrangements that exhibit a motif grid composed of an at least locally periodic arrangement of micromotif elements in the form of a first one- or two-dimensional lattice, exhibit a focusing element grid composed of an at least locally periodic arrangement of a plurality of microfocusing elements in the form of a second one- or two-dimensional lattice for moiré-magnified viewing of the micromotif elements, the motif grid and the focusing element grid being arranged on the endless material, gaplessly and free of misalignment, with a specified pattern repeat.

The first and second lattice can especially be one-dimensional translation lattices or also two-dimensional Bravais lattices. Here, the motif grid and the focusing element grid are preferably arranged on the endless material, gaplessly and free of misalignment, with the specified pattern repeat, on a length of 10 meters or more, preferably on a length of 100 meters or more, particularly preferably on a length of 1,000 meters or more.

The motif grid and the focusing element grid of the endless material are preferably arranged along the endless longitudinal direction of the endless material with a pattern repeat q and/or along the transverse direction of the endless material with a pattern repeat b.

The present invention further comprises a method for manufacturing a security element for security papers, value documents and the like, in which an endless material of the kind described is manufactured and cut in the desired shape of the security element. Here, the endless material is especially cut into longitudinal strips of equal width and having an identical arrangement of the micro-optical moiré magnification arrangements. The present invention also comprises a security element for security papers, value documents and the like that is manufactured from an endless material of the kind described, especially with the method just cited.

In a further aspect, the present invention comprises a method for manufacturing an impression or embossing cylinder for producing the focusing element grid in a manufacturing method for endless material of the kind described, in which a focusing element grid composed of an at least locally periodic arrangement of a plurality of microfocusing elements in the form of a one- or two-dimensional lattice, as well as the circumference q of the finished impression or embossing cylinder, is specified, the lattice of the focusing element grid is distorted by means of a linear transformation such that it repeats periodically in the pattern repeat of the specified circumference q, and an impression or embossing cylinder is provided with the distorted focusing element grid.

Here, a flat plate is preferably provided with the distorted focusing element grid, and the flat plate or a flat casting of the plate is fitted on an impression or embossing cylinder such that a cylinder having seams is created having a cylinder circumference q. According to a likewise advantageous alternative method, a coated cylinder having a cylinder circumference q is provided with the distorted focusing element grid through a material-ablation process, especially through laser ablation. The first and second lattice can especially be one-dimensional translation lattices or also two-dimensional Bravais lattices.

In a further aspect, the present invention comprises a method for manufacturing an impression or embossing cylinder for producing the motif grid in a manufacturing method for endless material of the kind described, in which a motif grid composed of an at least locally periodic arrangement of a plurality of micromotif elements in the form of a one- or two-dimensional Bravais lattice, as well as the circumference q of the finished impression or embossing cylinder, is specified, the lattice of the motif grid is distorted by means of a linear transformation such that it repeats periodically in the pattern repeat of the specified circumference q, and an impression or embossing cylinder is provided with the distorted motif grid.

Here, a flat plate is advantageously provided with the distorted motif grid, and the flat plate or a flat casting of the plate is fitted on an impression or embossing cylinder such that a cylinder having seams is created having a cylinder circumference q. According to a likewise advantageous alternative method, a coated cylinder having a cylinder circumference q is provided with the distorted motif grid through a material-ablation process, especially through laser ablation. The first and second lattice can especially be one-dimensional translation lattices or also two-dimensional Bravais lattices.

Furthermore, the present invention comprises an impression or embossing cylinder for producing a focusing element grid or a motif grid that is manufacturable in the described manner.

In all variants, the moiré magnification arrangements can exhibit, as focusing element grids, especially lens grids, but also different grids, such as hole grids or grids of concave reflectors. In all of these cases, the method according to the present invention can be used to advantage, especially if cylindrical dies are used for embossing or impressing.

Further exemplary embodiments and advantages of the present invention are described below with reference to the drawings. To improve clarity, a depiction to scale and proportion was dispensed with in the drawings.

DETAILED DESCRIPTION OF THE PREFERRED EMBODIMENTS

Figure 1:
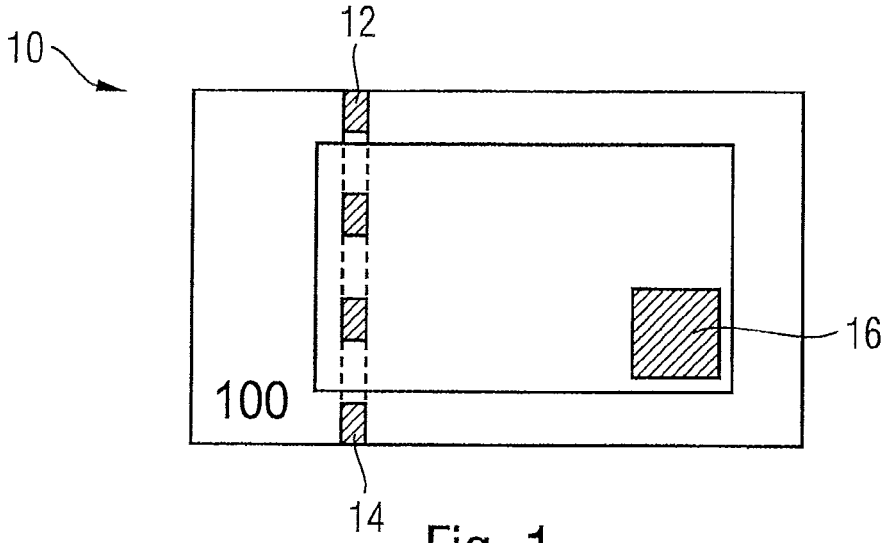
FIG. 1 is a schematic diagram of a banknote having an embedded security thread and an affixed transfer element.

The invention will now be explained using a security element for a banknote as an example. For this, FIG. 1 shows a schematic diagram of a banknote 10 that is provided with two security elements 12 and 16 according to exemplary embodiments of the present invention. The first security element constitutes a security thread 12 that emerges at certain window regions 14 on the surface of the banknote 10, while it is embedded in the interior of the banknote 10 in the areas lying therebetween. The second security element is formed by an affixed transfer element 16 of arbitrary shape. The security element 16 can also be developed in the form of a cover foil that is arranged over a window region or a through opening in the banknote.

Both the security thread 12 and the transfer element 16 can include a moiré magnification arrangement according to an exemplary embodiment of the present invention. The operating principle and the inventive manufacturing method for such arrangements are described in greater detail in the following based on the security thread 12.

Figure 2:
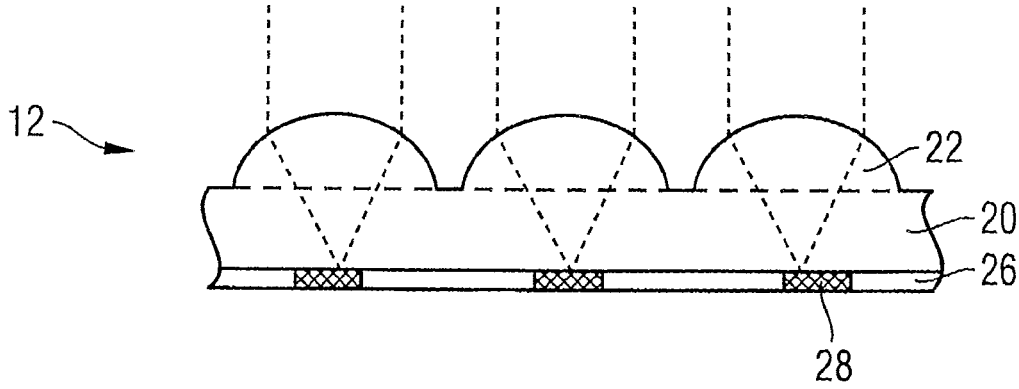
FIG. 2 is a schematic diagram of the layer structure of a security thread according to the present invention, in cross section.

FIG. 2 shows schematically the layer structure of a security thread 12, in cross section, with only the portions of the layer structure that are required to explain the functional principle being depicted. The security thread 12 includes a substrate 20 in the form of a transparent plastic foil, in the exemplary embodiment a polyethylene terephthalate (PET) foil about 20 μm thick. The top of the substrate foil 20 is provided with a grid-shaped arrangement of microlenses 22 that form, on the surface of the substrate foil, a two-dimensional Bravais lattice having a prechosen symmetry. The Bravais lattice can exhibit, for example, a hexagonal lattice symmetry, but due to the higher counterfeit security, lower symmetries, and thus more general shapes, are preferred, especially the symmetry of a parallelogram lattice.

The spacing of adjacent microlenses 22 is preferably chosen to be as small as possible in order to ensure as high an areal coverage as possible and thus a high-contrast depiction. The spherically or aspherically designed microlenses 22 preferably exhibit a diameter between 5 μm and 50 μm and especially a diameter between merely 10 μm and 35 μm and are thus not perceptible with the naked eye. It is understood that, in other designs, also larger or smaller dimensions may be used. For example, the microlenses in moiré magnifier patterns can exhibit, for decorative purposes, a diameter between 50 μm and 5 mm, while in moiré magnifier patterns that are to be decodable only with a magnifier or a microscope, also dimensions below 5 μm can be used.

On the bottom of the substrate foil 20, a motif layer 26 is arranged that includes a likewise grid-shaped arrangement of identical micromotif elements 28. Also the arrangement of the micromotif elements 28 forms a two-dimensional Bravais lattice having a prechosen symmetry, a parallelogram lattice again being assumed for illustration. As indicated in FIG. 2 through the offset of the micromotif elements 28 with respect to the microlenses 22, according to the present invention, the Bravais lattice of the micromotif elements 28 differs slightly in its symmetry and/or in the size of its lattice parameters from the Bravais lattice of the microlenses 22 to produce the desired moiré magnification effect. Here, the lattice period and the diameter of the micromotif elements 28 are on the same order of magnitude as those of the microlenses 22, so preferably in the range from 5 μm to 50 μm and especially in the range from 10 μm to 35 μm, such that also the micromotif elements 28 are not perceptible even with the naked eye. In designs having the above-mentioned larger or smaller microlenses, of course also the micromotif elements are developed to be a larger or smaller, accordingly.

The optical thickness of the substrate foil 20 and the focal length of the microlenses 22 are coordinated with each other such that the micromotif elements 28 are spaced approximately the lens focal length apart. The substrate foil 20 thus forms an optical spacing layer that ensures a desired constant spacing of the microlenses 22 and of the micromotif elements 28.

Due to the slightly differing lattice parameters, the viewer sees, when viewing from above through the microlenses 22, a somewhat different sub-region of the micromotif elements 28 each time, such that the plurality of microlenses 22 produces, overall, a magnified image of the micromotif elements 28. Here, the resulting moiré magnification depends on the relative difference between the lattice parameters of the Bravais lattices used. If, for example, the grating periods of two hexagonal lattices differ by 1%, then a 100× moiré magnification results. For a more detailed description of the operating principle and for advantageous arrangements of the micromotif elements and the microlenses, reference is made to the likewise pending German patent application 10 2005 062 132.5 and the international application PCT/EP2006/012374, the disclosures of which are incorporated herein by reference.

Figure 3A:
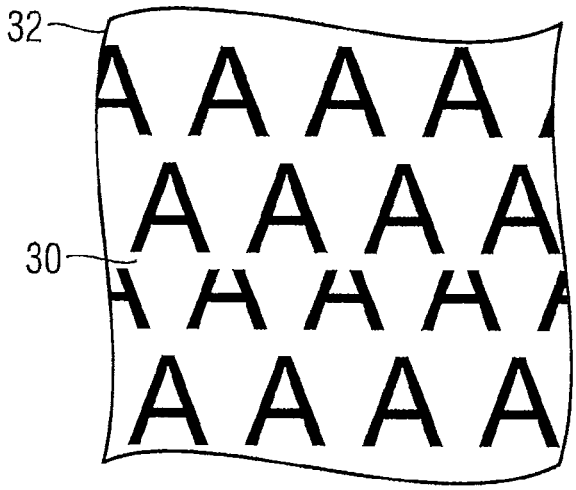
FIG. 3 is an illustration of the breaking points, in the appearance of security elements having moiré magnification arrangements, that occur in manufacturing methods according to the background art.
Figure 3B:
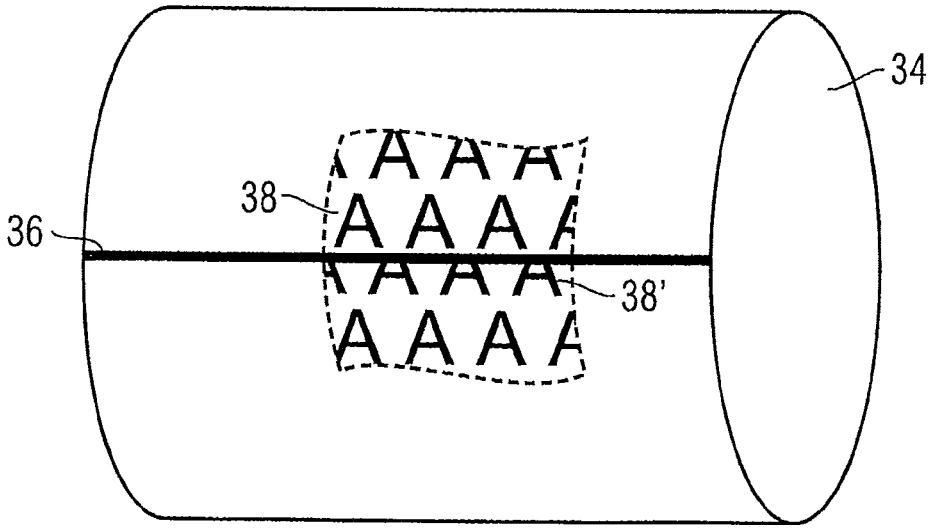

In the manufacture of security elements having such moiré magnification arrangements, normally, an endless security element foil is first manufactured as the roll material, wherein, in known manufacturing methods, breaking points 30 always occur in the appearance 32, as illustrated in FIG. 3(*a*). These breaking points in the appearance come from the fact that the pre-products for the embossing dies used in manufacturing are generally manufactured as flat plates that are fitted on an impression or embossing cylinder 34, as shown schematically in FIG. 3(*b*). At the seams 36, the adjoining motif grids 38, 38' and/or the associated lens grids normally do not match and, after impressing or embossing, lead to motif disturbances in the form of gaps or a misalignment in the appearance of the finished security elements.

Even if the designs required for moiré magnification arrangements are produced without an indirect route through flat plates directly in cylindrical form, the complex patterns of the lens grid and of the motif grid normally do not fit without breaks, in other words gaplessly and free of misalignment, on a specified cylinder jacket.

For the explanation of the approach according to the present invention, the required variables will first be defined and briefly described with reference to FIGS. 4 and 5. For a more precise description, reference is additionally made to the already cited German patent application 10 2005 062 132.5 and the international application PCT/EP2006/012374, the disclosures of which are incorporated herein by reference.

According to the present invention, the micromotif elements 28 and the microlenses 22 are each present in the form of a grid, a grid being understood, within the scope of this description, to be a two-dimensional periodic or at least locally periodic arrangement of the lenses or of the motif elements. A periodic grid can always be described by a Bravais lattice having constant lattice parameters. In a locally periodic arrangement, the period parameters can change from location to location, although only slowly in relation to the periodicity length such that, locally, the microgrid can always be described with sufficient precision by Bravais lattices having constant lattice parameters. Therefore, in the following, a periodic arrangement of the microelements will always be assumed for the sake of simpler illustration.

Figure 4:
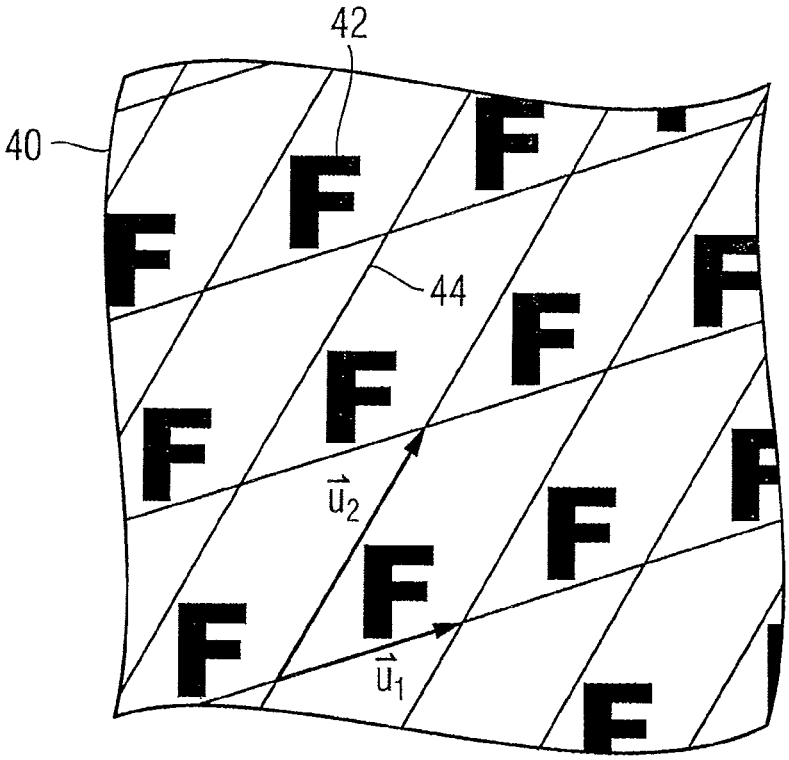
FIG. 4 is a motif grid whose micromotif elements are formed by a letter "F" lying on the lattice sites of a low-symmetry Bravais lattice.
Figure 5:
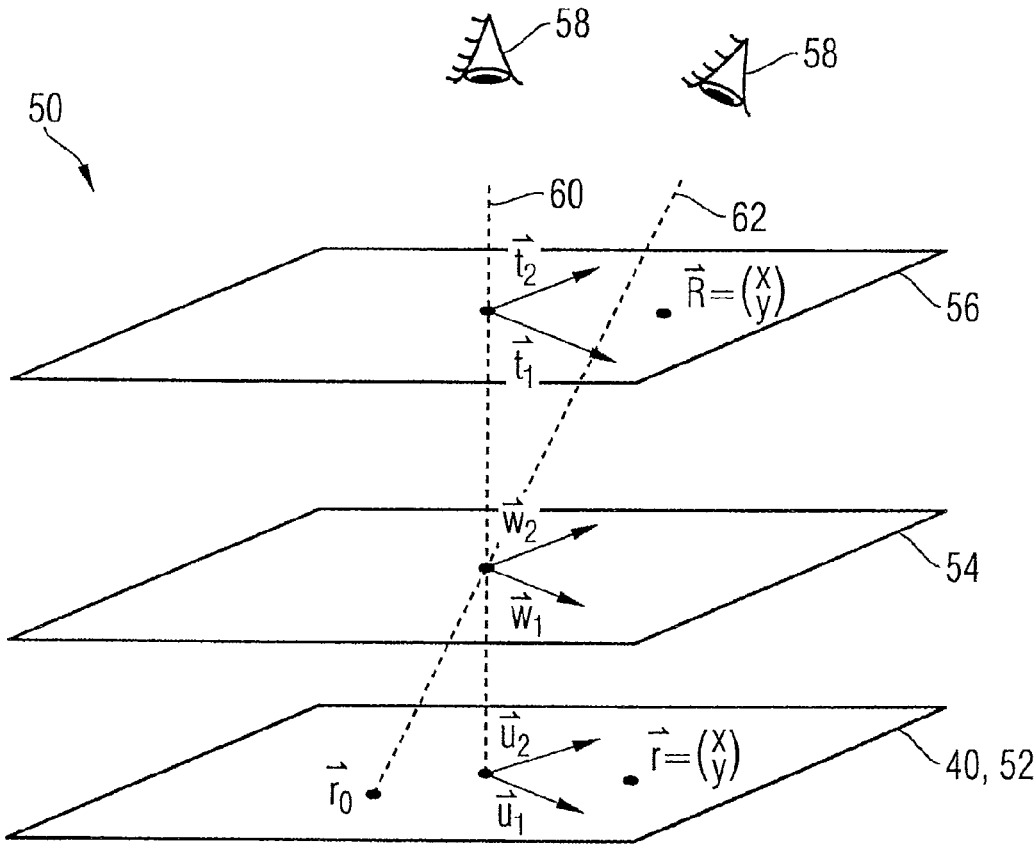
FIG. 5 is a schematic diagram of the relationships when viewing a moiré magnification arrangement, to define the occurring variables.

FIGS. 4 and 5 show schematically a moiré magnification arrangement 50, which is not depicted to scale, having a motif plane 52 in which a motif grid 40, depicted in greater detail in FIG. 4, is arranged and having a lens plane 54 in which the microlens grid is located. The moiré magnification arrangement 50 produces a moiré image plane 56 in which the magnified image perceived by the viewer 58 is described.

The motif grid 40 includes a plurality of micromotif elements 42 in the shape of the letter "F" that are arranged at the lattice sites of a low-symmetry Bravais lattice 44. The unit cell of the parallelogram lattice shown in FIG. 4 can be described by vectors $\vec{u}_1$ and $\vec{u}_2$ (having the components $u_{11}$, $u_{21}$ and $u_{12}$, $u_{22}$). In compact notation, the unit cell can also be specified in matrix form by a motif grid matrix $\overleftrightarrow{U}$ :

$$\overleftrightarrow{U} = (\vec{u}_1, \vec{u}_2) = \begin{pmatrix} u_{11} & u_{12} \\ u_{21} & u_{22} \end{pmatrix}$$

In the same way, the arrangement of microlenses in the lens plane 54 is described by a two-dimensional Bravais lattice whose lattice cell is specified by the vectors $\vec{w}_1$ and $\vec{w}_2$ (having the components $w_{11}$, $w_{21}$ and $w_{12}$, $w_{22}$). The lattice cell in the moiré image plane 56 is described with the vectors $\vec{t}_1$ and $\vec{t}_2$ (having the components $t_{11}$, $t_{21}$ and $t_{12}$, $t_{22}$).

$$\vec{r} = \begin{pmatrix} x \\ y \end{pmatrix}$$

designates a general point in the motif plane 52, $$\vec{R} = \begin{pmatrix} X \\ Y \end{pmatrix}$$

a general point in the moiré image plane 56. These variables are already sufficient to describe a vertical viewing (viewing direction 60) of the moiré magnification arrangement. To be able to take also non-vertical viewing directions into account, such as the direction 62, a displacement is additionally permitted between the lens plane 54 and the motif plane 52 that is specified by a displacement vector $$\vec{r}_0 = \begin{pmatrix} x_0 \\ y_0 \end{pmatrix}$$

in the motif plane 52. Analogously to the motif grid matrix, the matrices $$\overleftrightarrow{W} = \begin{pmatrix} w_{11} & w_{12} \\ w_{21} & w_{22} \end{pmatrix} \text{ and } \overleftrightarrow{T} = \begin{pmatrix} t_{11} & t_{12} \\ t_{21} & t_{22} \end{pmatrix}$$

are used for the compact description of the lens grid and the image grid.

The moiré image lattice results from the lattice vectors of the micromotif element arrangement and the microlens arrangement as $$\overleftrightarrow{T} = \overleftrightarrow{W} \cdot (\overleftrightarrow{W} - \overleftrightarrow{U})^{-1} \cdot \overleftrightarrow{U}$$

and the image points of the moiré image plane 56 can be determined with the aid of the relationship $$\vec{R} = \vec{W} \cdot (\overleftrightarrow{W} \cdot - \overleftrightarrow{U})^{-1} \cdot (\vec{r} - \vec{r}_0)$$

from the image points of the motif plane 52. Conversely, the lattice vectors of the micromotif element arrangement result from the lens grid and the desired moiré image lattice through $$\overleftrightarrow{U} = \overleftrightarrow{W} \cdot (\overleftrightarrow{T} + \overleftrightarrow{W})^{-1} \cdot \overleftrightarrow{T}$$

and $$\vec{r} = \overleftrightarrow{W} \cdot (\overleftrightarrow{T} + \overleftrightarrow{W})^{-1} \cdot \vec{R} + \vec{r}_0.$$

If the transformation matrix $$\overleftrightarrow{A} = \overleftrightarrow{W} \cdot (\overleftrightarrow{W} - \overleftrightarrow{U})^{-1}$$

is defined that transitions the coordinates of the points in the motif plane 52 and the points in the moiré image plane 56, $$\vec{R} = \overleftrightarrow{A} \cdot (\vec{r} - \vec{r}_0) \text{ and } \vec{r} = \overleftrightarrow{A}^{-1} \cdot \vec{R} + \vec{r}_0$$

then, from two of the four matrices $\overleftrightarrow{U}, \overleftrightarrow{W}, \overleftrightarrow{T}, \overleftrightarrow{A}$ in each case, the other two can be calculated. In particular:

$$\overleftrightarrow{T} = \overleftrightarrow{A} \cdot \overleftrightarrow{U} = \overleftrightarrow{W} \cdot (\overleftrightarrow{W} - \overleftrightarrow{U})^{-1} \cdot \overleftrightarrow{U} = (\overleftrightarrow{A} - \overleftrightarrow{I}) \cdot \overleftrightarrow{W} \quad \text{(M1)}$$

$$\overleftrightarrow{U} = \overleftrightarrow{W} \cdot (\overleftrightarrow{T} + \overleftrightarrow{W})^{-1} \cdot \overleftrightarrow{T} = \overleftrightarrow{A}^{-1} \cdot \overleftrightarrow{T} = (\overleftrightarrow{I} - \overleftrightarrow{A}^{-1}) \cdot \overleftrightarrow{W} \quad \text{(M2)}$$

$$\overleftrightarrow{W} = \overleftrightarrow{U} \cdot (\overleftrightarrow{T} - \overleftrightarrow{U})^{-1} \cdot \overleftrightarrow{T} = (\overleftrightarrow{A} - \overleftrightarrow{I})^{-1} \cdot \overleftrightarrow{T} = (\overleftrightarrow{A} - \overleftrightarrow{I})^{-1} \cdot \overleftrightarrow{A} \cdot \overleftrightarrow{U} \quad \text{(M3)}$$

$$\overleftrightarrow{A} = \overleftrightarrow{W} \cdot (\overleftrightarrow{W} - \overleftrightarrow{U})^{-1} = (\overleftrightarrow{T} + \overleftrightarrow{W}) \cdot \overleftrightarrow{W}^{-1} = \overleftrightarrow{T} \cdot \overleftrightarrow{U})^{-1} \quad \text{(M4)}$$

applies.

The transformation matrix $\overleftrightarrow{A}$ also describes the movement of a moiré image upon the movement of the moiré-forming arrangement 50, which derives from the displacement of the motif plane 52 against the lens plane 54. It is possible to interpret the columns of the transformation matrix $\overleftrightarrow{A}$ as vectors, with $$\overleftrightarrow{A} = \begin{pmatrix} a_{11} & a_{12} \\ a_{21} & a_{22} \end{pmatrix}, \vec{a}_1 = \begin{pmatrix} a_{11} \\ a_{21} \end{pmatrix}, \vec{a}_2 = \begin{pmatrix} a_{12} \\ a_{22} \end{pmatrix}.$$

It is now seen that the vector $\vec{a}_1$ specifies in which direction the moiré image moves when the arrangement composed of the motif and lens grid is tilted laterally, and that the vector $\vec{a}_2$ specifies in which direction the moiré image moves when the arrangement composed of the motif and lens grid is tilted forward-backward.

For the specified $\overleftrightarrow{A}$, the movement direction results as follows: Upon tilting the motif plane laterally, the moiré moves at an angle $\gamma_1$ to the horizontal, given by $$\tan\gamma_1 = \frac{a_{21}}{a_{11}}.$$

Similarly, when tilted forward-backward, the moiré moves at an angle $\gamma_2$ to the horizontal, given by $$\tan\gamma_2 = \frac{a_{22}}{a_{12}}.$$

According to the present invention, especially the transformations given by (M1) to (M4) are now supplemented by further linear transformations that describe a distortion of the Bravais lattice of the motif grid or of the lens grid and that are chosen such that the motif grid and/or the lens grid repeat periodically in a specified pattern repeat. The inventive approach will now be explained in greater detail based on some concrete examples.

Example 1

Figure 6:
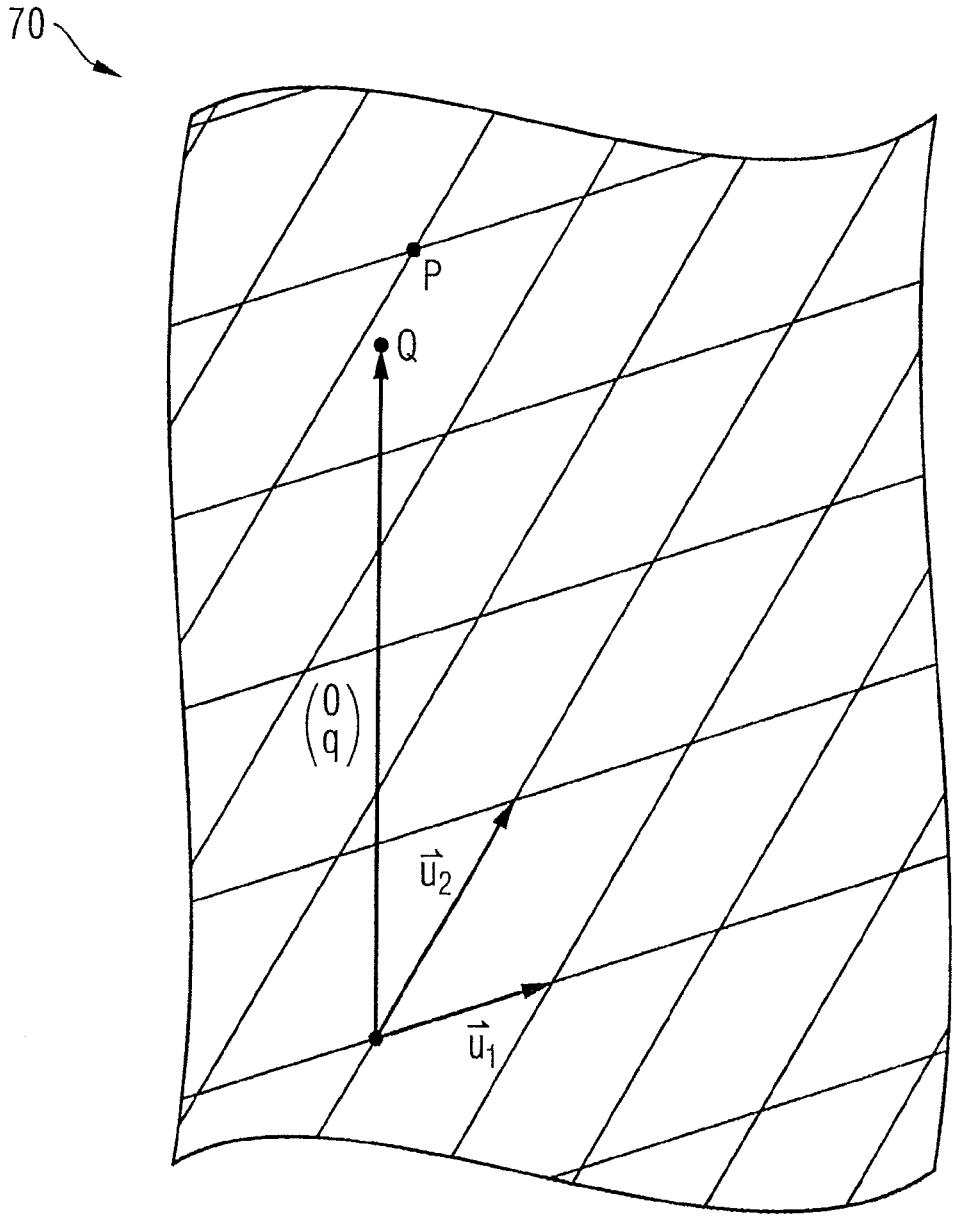
FIG. 6 is a motif grid in the form of a two-dimensional Bravais lattice having the unit-cell side vectors $\vec{u}_1$ and $\vec{u}_2$, and the plotted circumference q of the impression cylinder provided for producing the motif grid.

With reference to FIG. 6, a motif image 70 having a motif grid in the form of a two-dimensional Bravais lattice having the unit-cell side vectors $\vec{u}_1$ and $\vec{u}_2$ is specified, as well as the circumference q of the impression or embossing cylinder provided for producing the motif grid. Now, on the one hand, to accommodate the specified motif image without breaks on the cylinder, but while changing the specified motif grid as little as possible, according to the present invention, the following approach is used:

All lattice points of the specified motif grid are included by $$\{m \cdot \vec{u}_1 + n \cdot \vec{u}_2\}$$

with integers m and n. The motif image 70 can be applied interruption-free on a cylinder having the circumference q precisely when there are integers M and N for which:

$$M \cdot \vec{u}_1 + N \cdot \vec{u}_2 = \begin{pmatrix} 0 \\ q \end{pmatrix} \quad (1)$$

applies, wherein in the following, without loss of generality, the circumferential direction is chosen as the y-direction in a Cartesian coordinate system. The endpoint Q of this vector $$\begin{pmatrix} 0 \\ q \end{pmatrix}$$

defined by the circumference of the cylinder is likewise plotted in FIG. 6. A motif lattice calculated according to such aspects as motif size, magnification, movement, etc., or also a lens grid calculated accordingly, normally do not satisfy condition (1).

According to the present invention, the Bravais lattice of the motif grid 70 is thus slightly distorted by a linear transformation such that condition (1) is met for the distorted Bravais lattice. The distorted lattice then repeats periodically with a longitudinal pattern repeat q and thus fits without gaps and without misalignment on an associated impression or embossing cylinder having circumference q.

To determine a suitable transformation, a lattice point $$P = \begin{pmatrix} p_x \\ p_y \end{pmatrix}$$

of the undistorted Bravais lattice is selected that lies near the endpoint Q. For this, the lattice point P closest to the endpoint Q can be selected for as slight a distortion as possible, such as in FIG. 6. The concrete selection of the lattice point P can be made, for example, in that, by computer, the coordinates are determined of all lattice points in an area that is somewhat larger than one unwind of the cylinder (at least a few lattice cells larger in circumference and width) and that, from these lattice points, the one having the smallest distance to Q is then determined.

As can easily be seen, the linear transformation $$\overleftrightarrow{V} = \begin{pmatrix} 1 & 0 \\ 0 & q \end{pmatrix} \cdot \begin{pmatrix} 1 & p_x \\ 0 & p_y \end{pmatrix}^{-1} = \begin{pmatrix} 1 & -p_x/p_y \\ 0 & q/p_y \end{pmatrix} \tag{2a}$$

maps the lattice point P to the endpoint Q, and thus effects the desired distortion. As the new, slightly distorted Bravais lattice for the motif image, the motif grid lattice given by $$\overleftrightarrow{U}' = \overleftrightarrow{V} \cdot \overleftrightarrow{U}$$

is used. Accordingly, the new coordinates $$\vec{r}' = \begin{pmatrix} x' \\ y' \end{pmatrix}$$

of a general point $$\vec{r} = \begin{pmatrix} x \\ y \end{pmatrix}$$

of the motif plane 52 can be calculated by means of $$\begin{pmatrix} x' \\ y' \end{pmatrix} = \overleftrightarrow{V} \cdot \begin{pmatrix} x \\ y \end{pmatrix} = \begin{pmatrix} x - y \cdot p_x/p_y \\ y \cdot q/p_y \end{pmatrix}. \tag{4}$$

In this way, a motif image is obtained, having a motif grid in the form of a Bravais lattice having unit-cell side vectors $\vec{u}_1'$ and $\vec{u}_2'$ and image points $\vec{r}'$, given by the relationships (2a), (3) and (4), that fits on the specified impression or embossing cylinder gaplessly and without misalignment.

The effect of the lattice distortion carried out can be estimated based on the typical dimension of the embossing cylinder and the lattice cells. The lattice cell dimensions are commonly on the order of 20 μm, the circumference of a suitable embossing cylinder around 20 cm or more. Thus, for a distortion on the order of one lattice cell dimension, based on the cylinder circumference, a relative change of the lattice of just 1:10,000 results. Thus, the properties of the moiré image that is produced, such as magnification and movement angle, change only in the range of one-tenth of a percent, and are thus not perceptible for a viewer. Also the above-mentioned larger distances between lattice point P and endpoint Q still deliver very good to acceptable results for relative changes of the lattice in the range of up to a few percent.

Example 2

Like example 1, example 2 assumes a specified motif image composed of a motif grid in the form of a two-dimensional Bravais lattice having the unit-cell side vectors $\vec{u}_1$ and $\vec{u}_2$, as well as the circumference q of the impression cylinder provided for producing the motif grid.

For the lattice transformation, however, instead of the linear transformation defined by equation (2a), the more general linear transformation $$\overleftrightarrow{V} = \begin{pmatrix} b_x & 0 \\ b_y & q \end{pmatrix} \cdot \begin{pmatrix} a_x & p_x \\ a_y & p_y \end{pmatrix}^{-1} \tag{2b}$$

having arbitrary vectors $$\vec{b} = \begin{pmatrix} b_x \\ b_y \end{pmatrix} \text{ and } \vec{a} = \begin{pmatrix} a_x \\ a_y \end{pmatrix}$$

is used, which likewise maps the point P to the endpoint Q.

Here, the untransformed lattice and the transformed lattice differ as little as possible when the vectors $\vec{b}$ and $\vec{d}$ differ as little as possible or are even identical.

For illustration, some special cases are singled out:

2.1 If $\vec{b}$ and $\vec{a}$ are chosen to be identical in size and both are aligned to the circumferential direction of the cylinder, so $$\vec{a} = \vec{b} = \begin{pmatrix} b \\ 0 \end{pmatrix},$$

then the transformation (2b) is simplified to the above-specified transformation (2a).

2.2 If $\vec{b} = \vec{a} = \vec{u}_1$ is chosen, then, in the transformation, the lattice vector $\vec{u}_1$ is preserved, merely the lattice vector $\vec{u}_2$ is changed slightly such that the distorted lattice fits on the cylinder.

2.3 If $\vec{b} = \vec{a} = \vec{u}_2$ is chosen, then, in the transformation, the lattice vector $\vec{u}_2$ is preserved and the lattice vector $\vec{u}_1$ is changed slightly such that the distorted lattice fits on the cylinder.

Example 3

Figure 7:
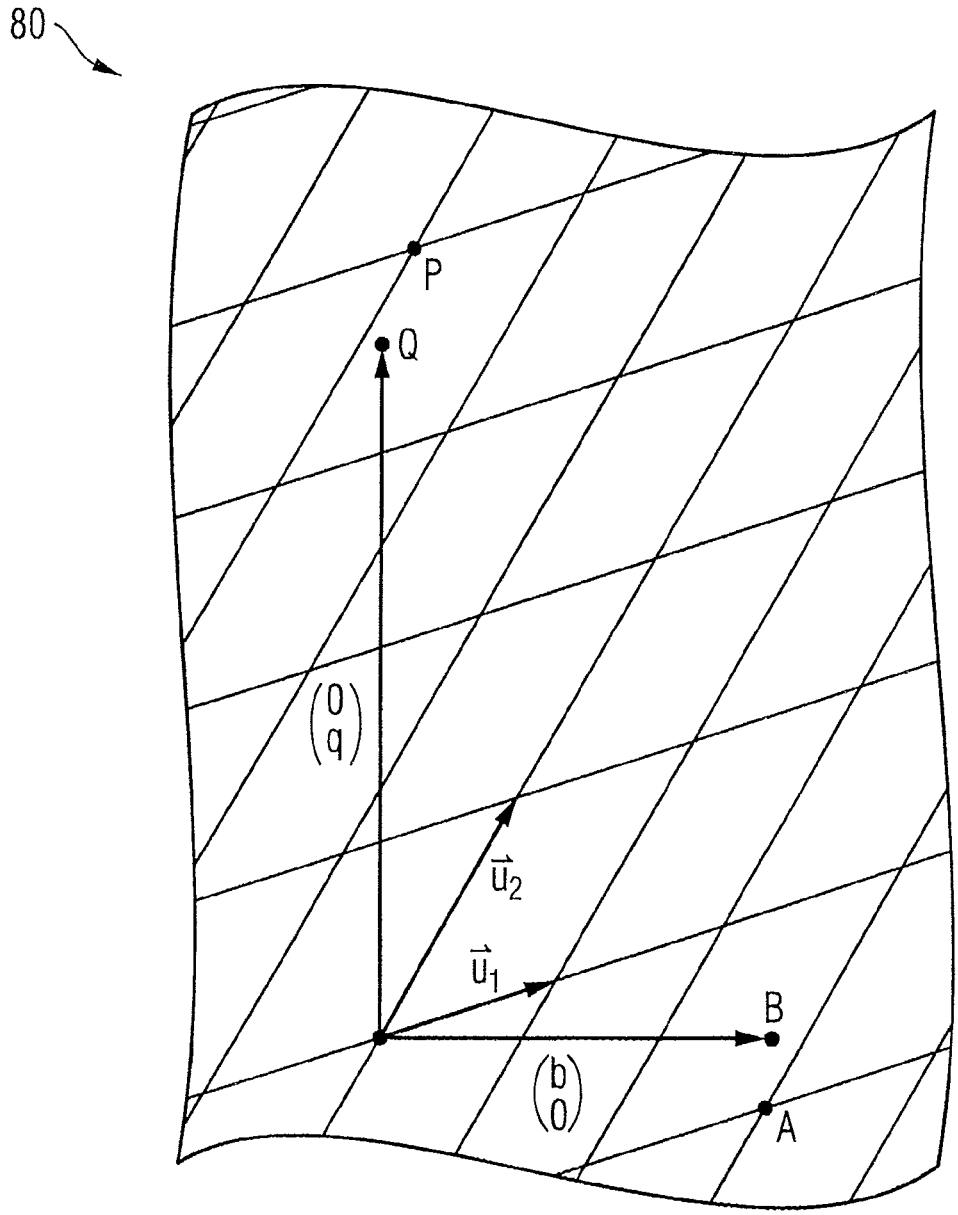
FIG. 7 is a motif grid as in FIG. 6 having the plotted circumference q and the width b of the strips into which the embossed endless material is to be cut.

With reference to FIG. 7, in example 3, as in example 1, a motif image 80 having a motif grid in the form of a two-dimensional Bravais lattice having the unit-cell side vectors $\vec{u}_1$ and $\vec{u}_2$ is specified as well as the circumference q of the impression or embossing cylinder provided for producing the motif grid. Furthermore, in a subsequent method step, the embossed endless material is to be cut into strips of width b, the moiré pattern being intended to lie laterally identically on all strips.

Thus, in this example, the distorted Bravais lattice of the motif image 80 is to repeat periodically in the y-direction with the longitudinal pattern repeat q, and periodically in the x-direction with the transverse pattern repeat b.

To determine a suitable transformation, according to the present invention, a lattice point $$P = \begin{pmatrix} p_x \\ p_y \end{pmatrix}$$

of the undistorted Bravais lattice is selected that lies the endpoint Q. In addition, a lattice point $$A = \begin{pmatrix} a_x \\ a_y \end{pmatrix}$$

is selected that lies near the endpoint B of the vector $$\begin{pmatrix} b \\ 0 \end{pmatrix}$$

given by the desired transverse pattern repeat.

As the linear transformation, the transformation $$\overleftrightarrow{V} = \begin{pmatrix} b & 0 \\ 0 & q \end{pmatrix} \cdot \begin{pmatrix} a_x & p_x \\ a_y & p_y \end{pmatrix}^{-1} \tag{2c}$$

is then used that, as can immediately be seen, represents a special case of the general transformation (2b) with $$\vec{b} = \begin{pmatrix} b \\ 0 \end{pmatrix}.$$

This transformation $\overleftrightarrow{V}$ maps the lattice point P to the endpoint Q and the lattice point A to the endpoint B. Since P and A were each chosen to be near the endpoints Q and B, the resulting distortion of the lattice is small.

The motif lattice transformed through the relationships (2c) and (3) and the motif image transformed through the relationships (2c) and (4) repeat, according to the design, with period b in the x-direction and with period q in the y-direction. The motif image thus fits gaplessly and without misalignment on the specified impression or embossing cylinder and, after manufacture, can be cut into identical strips of width b.

Example 4

Example 4 describes a preferred approach in manufacturing an entire moiré magnification arrangement:

First, a lattice arrangement $$\overleftrightarrow{W} = (\vec{w}_1, \vec{w}_2) = \begin{pmatrix} w_{11} & w_{12} \\ w_{21} & w_{22} \end{pmatrix}$$

for a lens grid is specified arbitrarily. In the event that this lattice arrangement does not match the cylinder circumference provided for the manufacture of the lens grid, it is, as described with reference in example 1 or 2, converted to a matching arrangement.

Furthermore, for the moiré pattern, a magnification and movement behavior is specified that, as explained above, can be expressed by a movement matrix $\overleftrightarrow{A}$. From the lens grid lattice $\overleftrightarrow{W}$ and the movement matrix $\overleftrightarrow{A}$, the motif grid lattice $\overleftrightarrow{U}$ can be determined with the aid of the relationship (M2):

$$\overleftrightarrow{U} = \overleftrightarrow{W} - \overleftrightarrow{A}^{-1} \cdot \overleftrightarrow{W}. \tag{5}$$

The resulting moiré pattern appears in the image plane having a lattice arrangement $\overleftrightarrow{T}$ that is given by $$\overleftrightarrow{T} = \overleftrightarrow{A} \cdot \overleftrightarrow{U}. \tag{6}$$

A motif image that is arranged in a motif grid lattice calculated according to relationship (5) will generally not fit interruption-free on an independently specified cylinder diameter, such that a foil material that is embossed with this cylinder displays, in the motif image and thus also in the moiré image, disruptions in the frequency of the cylinder circumference.

According to the present invention, the motif grid lattice $\overleftrightarrow{U}$ is thus replaced, as described in example 1 or 2, by a transformed motif grid lattice $$\overleftrightarrow{U}' = \overleftrightarrow{V} \cdot \overleftrightarrow{U}.$$

In this way, also a new movement matrix $\overleftrightarrow{A}'$ is obtained, the new magnification and movement behavior described by this movement matrix $\overleftrightarrow{A}'$ deviating, in the inventive approach, only marginally from the desired magnification and movement behavior described by the original movement matrix $\overleftrightarrow{A}$.

Concretely, the new movement matrix $\overleftrightarrow{A}'$ that describes the magnification and movement behavior of the transformed lattice is given by $$\overleftrightarrow{A}' = \overleftrightarrow{V} \cdot \overleftrightarrow{A} \cdot \overleftrightarrow{V}^{-1} \tag{7}$$

and the resulting transformed moiré pattern appears in the image plane having a lattice arrangement $\overleftrightarrow{T}'$ that is given by $$\overleftrightarrow{T}' = \overleftrightarrow{A}' \cdot \overleftrightarrow{U}' = \overleftrightarrow{V} \cdot \overleftrightarrow{T}. \tag{8}$$

Example 5

In example 5, a calculation example for moiré forming lattices is specified for the approaches explained in examples 1 to 4. For the sake of simpler illustration, a hexagonal lattice symmetry is assumed for the grids in each case.

A hexagonal lattice having a side length of 20 μm is specified as the lens grid. The motif grid is to have the same side length, but rotated at an angle of 0.573° with respect to the lens grid. The moiré pattern is to exhibit in the image plane an around 100-fold magnification and approximately orthoparallactic movement.

The lens grid lattice $\overleftrightarrow{W}$ is chosen such that it even fits on a cylinder having a 200 mm circumference:

$$\overleftrightarrow{W} = \begin{pmatrix} w_{11} & w_{12} \\ w_{21} & w_{22} \end{pmatrix} = 0.02 \cdot \begin{pmatrix} \cos 30° & \cos(-30°) \\ \sin 30° & \sin(-30°) \end{pmatrix} = 0.02 \cdot \begin{pmatrix} 0.866025\ldots & 0.866025\ldots \\ 0.5 & -0.5 \end{pmatrix}$$

For the motif grid lattice rotated by 0.573°, for the desired 100-fold magnification and approximately orthoparallactic movement, the result is:

$$\overleftrightarrow{U} = \begin{pmatrix} 0.01741965 & 0.01721964 \\ 0.00982628 & -0.01017271 \end{pmatrix}$$

However, this motif grid lattice does not fit interruption-free on a cylinder having a 200 mm circumference and is thus replaced, according to the present invention, by a transformed motif grid lattice $$\overleftrightarrow{U}' = \overleftrightarrow{V} \cdot \overleftrightarrow{U},$$

wherein $$V = \begin{pmatrix} 1 & 0 \\ 0 & 200 \end{pmatrix} \cdot \begin{pmatrix} 1 & p_x \\ 0 & p_y \end{pmatrix}^{-1}$$

where $(p_x; p_y)$=(0.00811617; 199.99992) is chosen, such that $$\overleftrightarrow{U}' = \begin{pmatrix} 0.01741924 & 0.01722006 \\ 0.00982630 & -0.01017271 \end{pmatrix}$$

results.

Here, the original and the transformed movement matrix are given by $$\overleftrightarrow{A} = \begin{pmatrix} 0.50000 & 99.99875 \\ -99.99875 & 0.50000 \end{pmatrix} \text{ and } \overleftrightarrow{A}' = \begin{pmatrix} 0.49796 & 99.99874 \\ -100.40622 & 0.49796 \end{pmatrix}$$

According to the design, in the original motif grid lattice, the moiré magnification is 100.0-fold, and the magnification with the transformed motif grid lattice is 100.4-fold horizontally and 100.0-fold vertically, so it changed only insignificantly. With the transformed motif grid lattice, a disturbance-free motif image results on an impression or embossing cylinder having a 200 mm circumference, while the original motif grid lattice leads to motif disturbances of the kind shown in FIG. 3(*a*).

Example 6

Example 6 is based on example 5, and in addition, in this example, the endless material produced is to be cut into identical strips having a width of 40 mm.

First, as in example 5, the undistorted motif grid lattice is calculated from the lens grid lattice and the desired magnification and movement behavior:

$$\overleftrightarrow{U} = \begin{pmatrix} 0.01741965 & 0.01721964 \\ 0.00982628 & -0.01017271 \end{pmatrix}$$

However, this motif grid lattice neither fits interruption-free on a cylinder having a 200 mm circumference, nor does it repeat periodically in 40 mm intervals. It is thus replaced, according to the present invention, by a transformed motif grid lattice $$\overleftrightarrow{U}' = \overleftrightarrow{V} \cdot \overleftrightarrow{U},$$

wherein $$\overleftrightarrow{V} = \begin{pmatrix} 40 & 0 \\ 0 & 200 \end{pmatrix} \cdot \begin{pmatrix} a_x & p_x \\ a_y & p_y \end{pmatrix}^{-1}$$

is chosen where $(p_x; p_y)$=(0.00811617; 199.99992) and $(a_x; a_y)$=(39.99495; −0.00994503), such that $$U' = \begin{pmatrix} 0.01742912 & 0.01722982 \\ 0.0098363 & -0.01015558 \end{pmatrix}$$

results.

In this case, for the transformed movement matrix, the result is:

$$\overleftrightarrow{A}' = \begin{pmatrix} 0.485129 & 102.55493 \\ 100.39976 & -0.788365 \end{pmatrix}$$

According to the design, the moiré magnification is 100.0-fold in the original motif grid lattice, and the magnification with the transformed motif grid lattice is 100.4-fold horizontally and 102.6-fold vertically, so it changed only a little. Furthermore, with the transformed motif grid lattice, on an impression or embossing cylinder having a 200 mm circumference, a disturbance-free motif image results that exhibits, for further processing, adjacent, identical strips of a width of 40 mm.

Example 7

As explained above, moiré magnifiers can be realized not only with two-dimensional lattices, but also with linear translation patterns, for instance with cylindrical lenses as the microfocusing elements and with motifs expanded arbitrarily in one direction as the micromotif elements. Also with such linear translation patterns, the moiré magnifier data can advantageously be adjusted to a specified pattern repeat, as now explained with reference to the motif images 90 and 95 in FIGS. 8 and 9.

Figure 8:
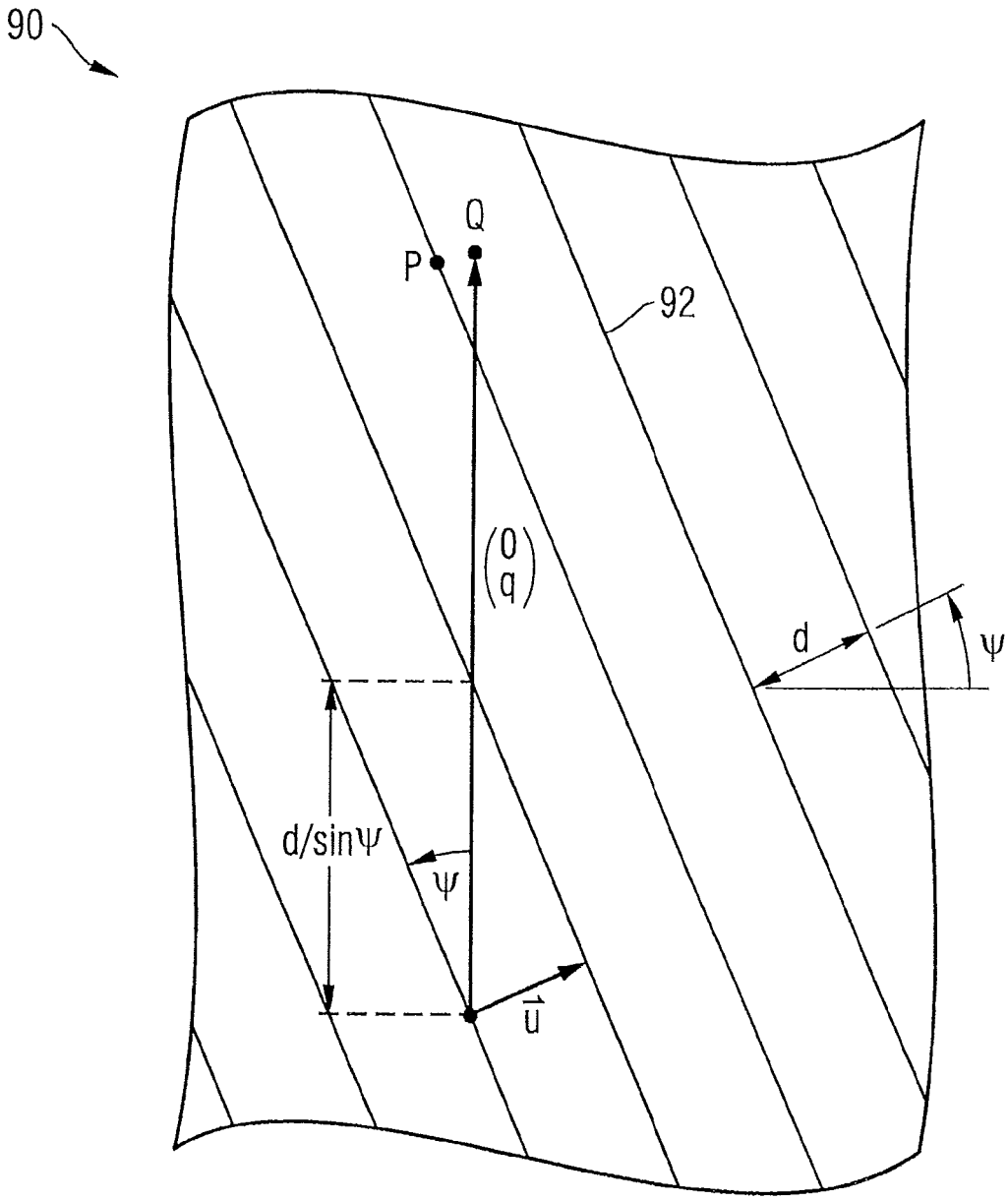
FIG. 8 is a motif grid in the form of a one-dimensional translation lattice having a translation vector $\vec{u}$ and the specified longitudinal pattern repeat q.

A linear translation pattern can be described by a translation vector $\vec{u}$, so by a displacement distance d and a displacement direction ψ, as shown in FIG. 8 (see also formula (N1) on p. 69 of the above-mentioned international application PCT/EP2006/012374). The parallel lines 92 in FIG. 8 stand schematically for a repeatedly arranged motif displaced with the translation vector $\vec{u}$. Moreover, a vector of length q having the endpoint Q is plotted that stands for the specified longitudinal pattern repeat.

Such a translation pattern can then be accommodated free of abutting points in the pattern repeat if ψ=0 is, or if there is an integer n such that $$nd/\sin\psi=q$$

applies. If, as in the exemplary embodiment depicted in FIG. 8, this is not the case, this condition can be met in the following way through a minor change in the variables d, ψ or q.

As already described in example 1, a transformation matrix V can be found with whose aid the motif pattern and the movement behavior can be adjusted with a minimal change to the pattern repeat. In FIG. 8, a point P is plotted that lies on the translation pattern near point Q.

The transformation V $$V=\begin{pmatrix}1 & 0\\ 0 & q\end{pmatrix}\cdot\begin{pmatrix}1 & p_x\\ 0 & p_y\end{pmatrix}^{-1}=\begin{pmatrix}1 & -p_x/p_y\\ 0 & q/p_y\end{pmatrix}$$

described by the above equation (2a) then maps point P to point Q.

Then, as the new, slightly distorted motif translation lattice that matches the specified pattern repeat, a lattice having the translation vector $$\vec{u}'=V\cdot\vec{u}$$

is used. In the motif plane that matches the specified pattern repeat, the new coordinates of a point (x',y') that are changed slightly with respect to the old coordinates (x,y) in the old motif plane that does not match the specified pattern repeat, are then, as in equation (4), given by $$\begin{pmatrix}x'\\ y'\end{pmatrix}=V\cdot\begin{pmatrix}x\\ y\end{pmatrix}=\begin{pmatrix}x-y\cdot p_x/p_y\\ y\cdot q/p_y\end{pmatrix}.$$

In the translation lattice that matches the specified pattern repeat, the new movement matrix A' that describes the movement behavior that is only slightly changed with respect to the old movement matrix A is, as in equation (7), given by:

$$A'=VAV^{-1}.$$

Figure 9:
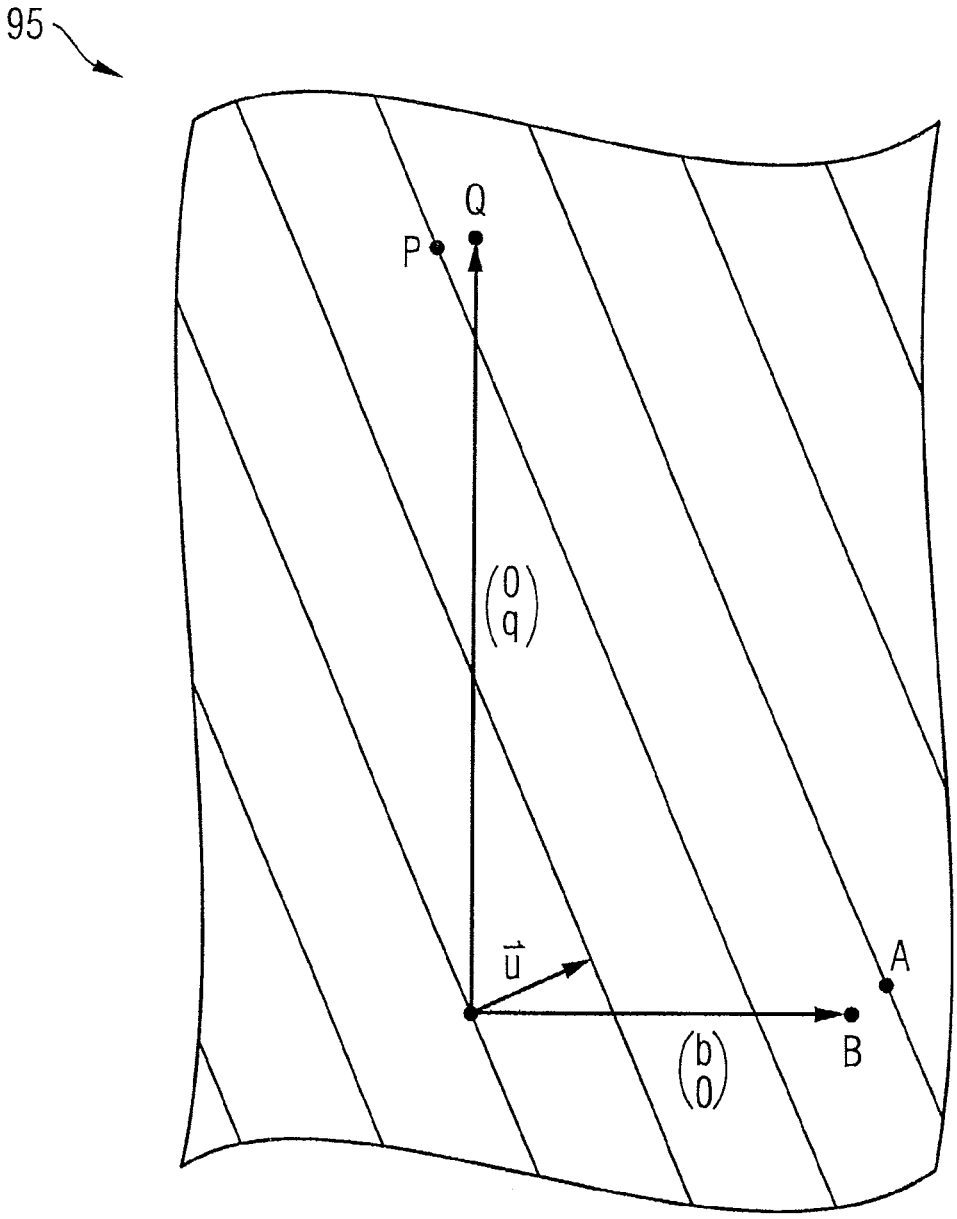
FIG. 9 is a motif grid as in FIG. 8 with the longitudinal pattern repeat q and transverse pattern repeat b plotted.

Analogously to the adjustment in a two-dimensional Bravais lattice according to example 3, also in a linear translation pattern, in addition to the adjustment to the longitudinal pattern repeat, also an adjustment to a transverse pattern repeat can occur, as exemplified with the motif image 95 in FIG. 9.

The longitudinal pattern repeat is depicted in FIG. 9 by a vector (0, q) having endpoint Q, and the transverse pattern repeat by a vector (b, 0) having endpoint B. Furthermore, points P and A having the coordinates $(p_x,p_y)$ and $(a_x, a_y)$ in the translation pattern are chosen that lie near Q and B.

As described in example 3, with these specifications, a transformation matrix V is found with whose aid the motif pattern and the movement behavior can be adjusted with minimal change to both pattern repeats, namely with equation (2c):

$$V=\begin{pmatrix}b & 0\\ 0 & q\end{pmatrix}\cdot\begin{pmatrix}a_x & p_x\\ a_y & p_y\end{pmatrix}^{-1}$$

It is understood that the methods described here for accommodating a motif grid seamlessly in a pattern repeat are also applicable for accommodating a lens grid seamlessly in a pattern repeat (e.g. on an embossing cylinder).

Example 8

Embossing or Impression Cylinders Having Seams

In the following, an example for the manufacture and seamless illustration of lens grid cylinders and motif grid cylinders that exhibit seams is described in greater detail, it being understood that also other methods known from the background art can be drawn on for the manufacture of the cylinders themselves.

In this example, the impression or embossing cylinders themselves exhibit seams, and the design of the moiré magnification arrangements is designed, according to the present invention, such that it matches up before and after a seam.

8.1 Lens Grid Cylinder:

Plates that have free-standing, generally cylindrical resist patterns that are arranged in the shape of a lattice and are referred to as lacquer points can be manufactured by means of different techniques. These lacquer points are produced in a lattice-shaped arrangement that results for the lens grid when the above-explained relationships (1) to (8) are used.

Such plates can be produced, for example, by means of classical photolithography, by means of lithographic direct-write methods, such as laser writing or e-beam lithography, or through suitable combinations of both approaches.

In a so-called "thermal reflow process," the plate having the lacquer points is then heated such that the resist patterns flow off and small mounds, preferably small spherical caps, form that are generally arranged in the shape of a lattice. Cast in transparent materials, these mounds have lens properties, the lens diameter, lens curvature, focal length, etc. being able to be determined through the geometric pattern of the lacquer points, especially their diameter and the thickness of the lacquer layer.

Direct patterning of the plates with free-standing mounds arranged in the shape of a lattice, for example with the aid of laser ablation, may likewise be used. Here, especially plastic, ceramic or metal surfaces are processed with high-energy laser radiation, for example with excimer laser radiation.

On a plate manufactured in this way, the so-called resist master, a nickel layer, for example 0.05 to 0.2 mm thick, is deposited and lifted from the plate. A nickel foil is obtained, the so-called shim, having depressions that correspond to the above-mentioned mounds in the resist master. This nickel foil is suitable as the embossing stamp for embossing a lens grid.

The nickel foil is precisely trimmed and, with the embossing depressions facing outward, welded to a cylindrical tube, the sleeve. The sleeve can be fitted on an embossing cylinder. Since the cylinder circumference including the sleeve was, according to the present invention, taken into account in the exposure control for the embossing pattern by using the relationships (1) to (8), the lattice period matches also in the area of the weld seam.

With the aid of this embossing cylinder, the calculated lens grid is then embossed in an embossable lacquer layer, for example a thermoplastic lacquer or UV lacquer, on the front of a foil.

8.2 Motif Grid Cylinder:

The manufacture occurs analogously to the lens grid cylinder, wherein plates having free-standing, freely designed motifs arranged in the shape of a lattice are manufactured.

Here, according to the present invention, the lens grid, motif grid and cylinder circumference are in the relationships given by the equations (1) to (8), such that the lattice period matches also in the area of the weld seam.

With the aid of this embossing cylinder, the motif grid is embossed in an embossable lacquer layer, for example a thermoplastic lacquer or UV lacquer, on the reverse of the foil that includes the associated lens grid on the front. To increase contrast, the motif grid can be colored, as explained in, for instance, the likewise pending German patent application 10 2006 029 852.7, the disclosure of which is incorporated herein by reference.

Overall, a moiré magnification arrangement is obtained that displays a magnified and moving motif and displays, in the embossing seams that occur in roll material, substantially improved behavior with respect to the background art.

The further processing of the foil that is embossed on both sides with a lens grid and a motif grid can occur in different manners. For example, the motif grid can be contiguously metalized, or the motif grid can be obliquely evaporated and, thereafter, an areal application of an ink layer can occur on the partially metalized surfaces, or the embossed motif grid can be colored through contiguous application of ink layers and subsequent wiping off, or by using the above-mentioned coloring technique of German patent application 10 2006 029 852.7.

Example 9

Embossing or Impression Cylinders without Seams

Seamless cylinders as such, for application in embossing or impression machines, are background art and are known, for example, from publications WO 2005/036216 A2 or DE 10126264 A1. To date, however, a teaching has been lacking on how such cylinders are to be designed in order to satisfy the special requirements in moiré magnification arrangements.

In a preferred moiré magnification arrangement, a lens grid is applied on one side of a foil and a matching motif grid on the other side of the foil. Here, embossing or impression cylinders are illustrated, for example, according to the method described in the background art, the design being executed according to the inventive calculation presented above using the relationships (1) to (8).

Such cylinders can be manufactured, for example, as follows, it being understood that also other methods known from the background art can be drawn on for the manufacture of the cylinders themselves.

9.1 Lens Grid Cylinder:

In a metal-, ceramic- or plastic-coated cylinder, through laser ablation, especially through material ablation with the aid of a computer-controlled laser, cavity-shaped depressions arranged in the shape of a lattice are produced that serve as the embossing or impression forms for a lens grid. Here, the laser advance control is programmed, according to the present invention, using the relationships (1) to (8) such that a seamless, interruption-free pattern is created on the cylinder.

9.2 Motif Grid Cylinder:

In a metal-, ceramic- or plastic-coated cylinder, depressed motifs or relief-like raised motifs that are arranged in the shape of a lattice and that serve as embossing or impression forms for a motif grid are introduced into depressed surroundings through laser ablation, especially through material ablation with the aid of a computer-controlled laser. Here, the laser advance control is programmed, according to the present invention, using the relationships (1) to (8) such that a seamless, interruption-free pattern is created on the cylinder.

With the aid of these embossing cylinders, an associated lens grid and motif grid are embossed in embossable lacquer layers, for example thermoplastic lacquer or UV lacquer, on the front and reverse of a foil. To increase contrast, the motif grid can be colored, as described in example 7.

According to the present invention, the lens grid, motif grid and cylinder circumferences are in the relationships given by equations (1) to (8), such that moiré magnification arrangements are obtained that exhibit a magnified and moving motif, and that, furthermore, in roll material, display no discontinuities in the periodicity.

It is to be noted that the cylinder circumferences of lens and motif cylinders can be identical or different, the calculation with the aid of the relationships (1) to (8) delivers, also in the latter case, the desired results with respect to the magnification and movement behavior of the moiré magnification arrangement with an interruption-free pattern.

The further processing of the foil that is embossed on both sides with a lens grid and a motif grid can occur in the manners described in example 7. Likewise, the mentioned lens grid and motif grid cylinders can be used as the impression forms. This is appropriate especially for the motif grid cylinders.

A particularly preferred manufacturing method is obtained when a lens grid is introduced into an embossable lacquer layer, for example a thermoplastic lacquer or UV lacquer, of a foil by means of embossing, and the associated motif grid is applied to the opposing side of the foil by means of classical printing methods or the method cited in German application 10 2006 029 852.7.

The invention claimed is:

1. A method for manufacturing endless material for security elements having micro-optical moiré magnification arrangements that exhibit a motif grid comprising a plurality of micromotif elements and a focusing element grid comprising a plurality of microfocusing elements for moiré-magnified viewing of the micromotif elements, the method comprising:

a) providing a motif grid comprising an at least locally periodic arrangement of micromotif elements in the form of a first one- or two-dimensional lattice, b) providing a focusing element grid comprising an at least locally periodic arrangement of a plurality of microfocusing elements in the form of a second one- or two-dimensional lattice, c) specifying a pattern repeat of the motif grid and/or of the focusing element grid on the endless material, d) determining whether the lattice of the motif grid and/or the lattice of the focusing element grid repeats periodically in the specified pattern repeat, and if not, determining a linear transformation that distorts the first and/or the second lattice such that it repeats periodically in the specified pattern repeat, and e) for the further manufacture of the endless material, replacing the motif grid or the focusing element grid by the motif grid that is distorted by the determined linear transformation, or the focusing element grid that is distorted by the determined linear transformation, wherein, in step c), a pattern repeat q along the endless longitudinal direction of the endless material is specified, wherein, in step d), a lattice point P of the first and/or the second lattice is selected that lies near an endpoint Q of a vector $$\begin{pmatrix} 0 \\ q \end{pmatrix}$$

given by the longitudinal pattern repeat, and a linear transformation V is determined that maps P to Q.

2. The method according to claim 1, wherein the longitudinal pattern repeat q is given by the circumference of an embossing or impression cylinder for producing the motif grid and/or the focusing element grid.

3. The method according to claim 1, wherein, as the lattice point lying near the endpoint Q, a lattice point P is chosen whose distance from Q along the lattice vector or both lattice vectors is in each case less than 10 lattice periods.

4. The method according to claim 1, wherein the lattice point closest to the endpoint Q is chosen as the lattice point P.

5. The method according to claim 1, wherein the linear transformation V is calculated using the relationship $$V = \begin{pmatrix} b_x & 0 \\ b_y & q \end{pmatrix} \cdot \begin{pmatrix} a_x & p_x \\ a_y & p_y \end{pmatrix}^{-1},$$

wherein $$\begin{pmatrix} p_x \\ p_y \end{pmatrix} \text{ and } \begin{pmatrix} 0 \\ q \end{pmatrix}$$

represent the coordinate vectors of the lattice point P and the endpoint Q, and $$\vec{b} = \begin{pmatrix} b_x \\ b_y \end{pmatrix} \text{ and } \vec{a} = \begin{pmatrix} a_x \\ a_y \end{pmatrix}$$

arbitrary vectors.

6. The method according to claim 1, wherein the linear transformation V is calculated using the relationship $$V = \begin{pmatrix} 1 & 0 \\ 0 & q \end{pmatrix} \cdot \begin{pmatrix} 1 & p_x \\ 0 & p_y \end{pmatrix}^{-1} = \begin{pmatrix} 1 & -p_x/p_y \\ 0 & q/p_y \end{pmatrix},$$

wherein $$\begin{pmatrix} p_x \\ p_y \end{pmatrix} \text{ and } \begin{pmatrix} 0 \\ q \end{pmatrix}$$

represent the coordinate vectors of the lattice point P and the endpoint Q.

7. A method for manufacturing endless material for security elements having micro-optical moiré magnification arrangements that exhibit a motif grid comprising a plurality of micromotif elements and a focusing element grid comprising a plurality of microfocusing elements for moiré-magnified viewing of the micromotif elements, the method comprising:

a) providing a motif grid comprising an at least locally periodic arrangement of micromotif elements in the form of a first one- or two-dimensional lattice, b) providing a focusing element grid comprising an at least locally periodic arrangement of a plurality of microfocusing elements in the form of a second one- or two-dimensional lattice, c) specifying a pattern repeat of the motif grid and/or of the focusing element grid on the endless material, d) determining whether the lattice of the motif grid and/or the lattice of the focusing element grid repeats periodically in the specified pattern repeat, and if not, determining a linear transformation that distorts the first and/or the second lattice such that it repeats periodically in the specified pattern repeat, and e) for the further manufacture of the endless material, replacing the motif grid or the focusing element grid by the motif grid that is distorted by the determined linear transformation, or the focusing element grid that is distorted by the determined linear transformation, wherein, in step c), a pattern repeat q along the endless longitudinal direction of the endless material is specified, wherein, in step c), a pattern repeat b along the transverse direction of the endless material is specified, wherein, in step d), a lattice point P of the first and/or the second lattice is selected that lies near the endpoint Q of the vector $$\begin{pmatrix} 0 \\ q \end{pmatrix}$$

given by the longitudinal pattern repeat, a lattice point A of the first and/or the second lattice is selected that lies near the endpoint B of the vector $$\begin{pmatrix} b \\ 0 \end{pmatrix}$$

given by the transverse pattern repeat, and a linear transformation V is determined that maps P to Q and A to B.

8. The method according to claim 7, further comprising cutting the endless material into parallel longitudinal strips, wherein the transverse pattern repeat b is given by the width of these longitudinal strips.

9. The method according to claim 7, wherein, as the lattice points lying near the endpoints Q and B, such lattice points P and A are chosen whose distances from Q and B along the lattice vector or both lattice vectors is in each case less than 10 lattice periods.

10. The method according to claim 7, wherein the lattice point closest to the endpoint Q is chosen as the lattice point P, and the lattice point closest to the endpoint B as the lattice point A.

11. The method according to claim 7, wherein the linear transformation V is calculated using the relationship $$V = \begin{pmatrix} b & 0 \\ 0 & q \end{pmatrix} \cdot \begin{pmatrix} a_x & p_x \\ a_y & p_y \end{pmatrix}^{-1},$$

wherein $$\begin{pmatrix} p_x \\ p_y \end{pmatrix} \text{ and } \begin{pmatrix} 0 \\ q \end{pmatrix}$$

represent the coordinate vectors of the lattice point P and the endpoint Q, and $$\begin{pmatrix} a_x \\ a_y \end{pmatrix} \text{ and } \begin{pmatrix} b \\ 0 \end{pmatrix}$$

the coordinate vectors of the lattice point A and the endpoint B.

12. A method for manufacturing endless material for security elements having micro-optical moiré magnification arrangements that exhibit a motif grid comprising a plurality of micromotif elements and a focusing element grid comprising a plurality of microfocusing elements for moiré-magnified viewing of the micromotif elements, the method comprising:

a) providing a motif grid comprising an at least locally periodic arrangement of micromotif elements in the form of a first one- or two-dimensional lattice, b) providing a focusing element grid comprising an at least locally periodic arrangement of a plurality of microfocusing elements in the form of a second one- or two-dimensional lattice, c) specifying a pattern repeat of the motif grid and/or of the focusing element grid on the endless material, d) determining whether the lattice of the motif grid and/or the lattice of the focusing element grid repeats periodically in the specified pattern repeat, and if not, determining a linear transformation that distorts the first and/or the second lattice such that it repeats periodically in the specified pattern repeat, and e) for the further manufacture of the endless material, replacing the motif grid or the focusing element grid by the motif grid that is distorted by the determined linear transformation, or the focusing element grid that is distorted by the determined linear transformation, wherein the first and second lattice are one-dimensional translation lattices.

13. A method for manufacturing endless material for security elements having micro-optical moiré magnification arrangements that exhibit a motif grid comprising a plurality of micromotif elements and a focusing element grid comprising a plurality of microfocusing elements for moiré-magnified viewing of the micromotif elements, the method comprising:

a) providing a motif grid comprising an at least locally periodic arrangement of micromotif elements in the form of a first one- or two-dimensional lattice, b) providing a focusing element grid comprising an at least locally periodic arrangement of a plurality of microfocusing elements in the form of a second one- or two-dimensional lattice, c) specifying a pattern repeat of the motif grid and/or of the focusing element grid on the endless material, d) determining whether the lattice of the motif grid and/or the lattice of the focusing element grid repeats periodically in the specified pattern repeat, and if not, determining a linear transformation that distorts the first and/or the second lattice such that it repeats periodically in the specified pattern repeat, and e) for the further manufacture of the endless material, replacing the motif grid or the focusing element grid by the motif grid that is distorted by the determined linear transformation, or the focusing element grid that is distorted by the determined linear transformation, wherein the first and second lattice are two-dimensional Bravais lattices, the method further comprising:

defining a desired image that is visible when viewed and has one or more moiré image elements, the arrangement of magnified moiré image elements being chosen in the form of a two-dimensional Bravais lattice whose lattice cells are given by vectors $\vec{t}_1$ and $\vec{t}_2$, providing the focusing element grid in step b) as an arrangement of microfocusing elements in the form of a two-dimensional Bravais lattice whose lattice cells are given by vectors $\vec{w}_1$ and $\vec{w}_2$, and in step a), calculating the motif grid having the micromotif elements using the relationships $$\overleftrightarrow{U} = \overleftrightarrow{W} \cdot (\overleftrightarrow{T} + \overleftrightarrow{W})^{-1} \cdot \overleftrightarrow{T}$$

and $$\vec{r} = \overleftrightarrow{W} \cdot (\overleftrightarrow{T} + \overleftrightarrow{W})^{-1} \cdot \vec{R} + \vec{r}_0,$$

wherein $$\vec{R} = \begin{pmatrix} X \\ Y \end{pmatrix}$$

represents an image point of the desired image, $$\vec{r} = \begin{pmatrix} x \\ y \end{pmatrix}$$

an image point of the motif grid, $$\vec{r}_0 = \begin{pmatrix} x_0 \\ y_0 \end{pmatrix}$$

a displacement between the arrangement of microfocusing elements and the arrangement of micromotif elements, and the matrices $\overleftrightarrow{T}$, $\overleftrightarrow{W}$ and $\overleftrightarrow{U}$ are given by $$\overleftrightarrow{T}=\begin{pmatrix} t_{11} & t_{12} \\ t_{21} & t_{22} \end{pmatrix},\ \overleftrightarrow{W}=\begin{pmatrix} w_{11} & w_{12} \\ w_{21} & w_{22} \end{pmatrix} \text{ and } \overleftrightarrow{U}=\begin{pmatrix} u_{11} & u_{12} \\ u_{21} & u_{22} \end{pmatrix},$$

with $t_{1i}$, $t_{2i}$, $u_{1i}$, $u_{2i}$ and $w_{1i}$, $w_{2i}$ representing the components of the lattice cell vectors $\overleftrightarrow{t}_i$, $\vec{u}_i$ and $\vec{w}_i$, where i=1, 2.

14. A method for manufacturing endless material for security elements having micro-optical moiré magnification arrangements that exhibit a motif grid comprising a plurality of micromotif elements and a focusing element grid comprising a plurality of microfocusing elements for moiré-magnified viewing of the micromotif elements, the method comprising:

a) providing a motif grid comprising an at least locally periodic arrangement of micromotif elements in the form of a first one- or two-dimensional lattice, b) providing a focusing element grid comprising an at least locally periodic arrangement of a plurality of microfocusing elements in the form of a second one- or two-dimensional lattice, c) specifying a pattern repeat of the motif grid and/or of the focusing element grid on the endless material, d) determining whether the lattice of the motif grid and/or the lattice of the focusing element grid repeats periodically in the specified pattern repeat, and if not, determining a linear transformation that distorts the first and/or the second lattice such that it repeats periodically in the specified pattern repeat, and e) for the further manufacture of the endless material, replacing the motif grid or the focusing element grid by the motif grid that is distorted by the determined linear transformation, or the focusing element grid that is distorted by the determined linear transformation, wherein the first and second lattice are two-dimensional Bravais lattices, the method further comprising:

defining a desired image that is visible when viewed and has one or more moiré image elements, providing the focusing element grid in step b) as an arrangement of microfocusing elements in the form of a two-dimensional Bravais lattice whose lattice cells are given by vectors $\vec{w}_1$ and $\vec{w}_2$, defining a desired movement of the visible image when the moiré magnification arrangement is tilted laterally and when tilted forward and back, the desired movement being specified in the form of the matrix elements of a transformation matrix, $\overleftrightarrow{A}$, and in step a), calculating the motif grid having the micromotif elements using the relationships $$\overleftrightarrow{U}=\left(\overleftrightarrow{I}-\overleftrightarrow{A}^{-1}\right)\cdot\overleftrightarrow{W}$$

and $$\vec{r}=\overleftrightarrow{A}^{-1}\cdot\vec{R}+\vec{r}_0,$$

wherein $$\vec{R}=\begin{pmatrix} X \\ Y \end{pmatrix}$$

represents an image point of the desired image, $$\vec{r}=\begin{pmatrix} x \\ y \end{pmatrix}$$

an image point of the motif image, $$\vec{r}=\begin{pmatrix} x_0 \\ y_0 \end{pmatrix}$$

a displacement between the arrangement of microfocusing elements and the arrangement of micromotif elements, and the matrices $\overleftrightarrow{A}$, $\overleftrightarrow{W}$ and $\overleftrightarrow{U}$ are given by $$\overleftrightarrow{A}=\begin{pmatrix} a_{11} & a_{12} \\ a_{21} & a_{22} \end{pmatrix},\ \overleftrightarrow{W}=\begin{pmatrix} w_{11} & w_{12} \\ w_{21} & w_{22} \end{pmatrix} \text{ and } \overleftrightarrow{U}=\begin{pmatrix} u_{11} & u_{12} \\ u_{21} & u_{22} \end{pmatrix},$$

with $u_{1i}$, $u_{2i}$ and $w_{1i}$, $w_{2i}$ representing the components of the lattice cell vectors $\vec{u}_i$ and $\vec{w}_i$, where i=1, 2.

15. The method according to claim 1, wherein the motif grid and the focusing element grid are arranged at opposing surfaces of an optical spacing layer.

16. The method according to claim 1, wherein step e) comprises providing an impression or embossing cylinder with the distorted focusing element grid.

17. The method according to claim 16, wherein, in step e), a flat plate is provided with the distorted focusing element grid, and the flat plate or a flat casting of the plate is fitted on an impression or embossing cylinder such that a cylinder having seams is created having a cylinder circumference q.

18. The method according to claim 16, wherein, in step e), a coated cylinder having a cylinder circumference q is provided with the distorted focusing element grid through a material-ablation process, especially through laser ablation.

19. The method according to claim 1, wherein step e) comprises embossing the distorted focusing element grid in an embossable lacquer layer.

20. The method according to claim 1, wherein step e) comprises providing an impression or embossing cylinder with the distorted motif grid.

21. The method according to claim 20, wherein, in step e), a flat plate is provided with the distorted motif grid, and the flat plate or a flat casting of the plate is fitted on an impression or embossing cylinder such that a cylinder having seams is created having a cylinder circumference q.

22. The method according to claim 20, wherein, in step e), a coated cylinder having a cylinder circumference q is provided with the distorted motif grid through a material-ablation process, especially through laser ablation.

23. The method according to claim 1, wherein step e) comprises embossing the distorted motif grid in an embossable lacquer layer.

24. The method according to claim 1, wherein step e) comprises imprinting the distorted motif grid on a substrate layer, especially on an optical spacing layer.

25. The method according to claim 7, wherein the motif grid and the focusing element grid are arranged at opposing surfaces of an optical spacing layer.

26. The method according to claim 7, wherein step e) comprises providing an impression or embossing cylinder with the distorted focusing element grid.

27. The method according to claim 26, wherein, in step e), a flat plate is provided with the distorted focusing element grid, and the flat plate or a flat casting of the plate is fitted on an impression or embossing cylinder such that a cylinder having seams is created having a cylinder circumference q.

28. The method according to claim 26, wherein, in step e), a coated cylinder having a cylinder circumference q is provided with the distorted focusing element grid through a material-ablation process, especially through laser ablation.

29. The method according to claim 7, wherein step e) comprises embossing the distorted focusing element grid in an embossable lacquer layer.

30. The method according to claim 7, wherein step e) comprises providing an impression or embossing cylinder with the distorted motif grid.

31. The method according to claim 30, wherein, in step e), a flat plate is provided with the distorted motif grid, and the flat plate or a flat casting of the plate is fitted on an impression or embossing cylinder such that a cylinder having seams is created having a cylinder circumference q.

32. The method according to claim 30, wherein, in step e), a coated cylinder having a cylinder circumference q is provided with the distorted motif grid through a material-ablation process, especially through laser ablation.

33. The method according to claim 7, wherein step e) comprises embossing the distorted motif grid in an embossable lacquer layer.

34. The method according to claim 7, wherein step e) comprises imprinting the distorted motif grid on a substrate layer, especially on an optical spacing layer.

35. The method according to claim 12, wherein the motif grid and the focusing element grid are arranged at opposing surfaces of an optical spacing layer.

36. The method according to claim 12, wherein step e) comprises providing an impression or embossing cylinder with the distorted focusing element grid.

37. The method according to claim 36, wherein, in step e), a flat plate is provided with the distorted focusing element grid, and the flat plate or a flat casting of the plate is fitted on an impression or embossing cylinder such that a cylinder having seams is created having a cylinder circumference q.

38. The method according to claim 36, wherein, in step e), a coated cylinder having a cylinder circumference q is provided with the distorted focusing element grid through a material-ablation process, especially through laser ablation.

39. The method according to claim 12, wherein step e) comprises embossing the distorted focusing element grid in an embossable lacquer layer.

40. The method according to claim 12, wherein step e) comprises providing an impression or embossing cylinder with the distorted motif grid.

41. The method according to claim 40, wherein, in step e), a flat plate is provided with the distorted motif grid, and the flat plate or a flat casting of the plate is fitted on an impression or embossing cylinder such that a cylinder having seams is created having a cylinder circumference q.

42. The method according to claim 40, wherein, in step e), a coated cylinder having a cylinder circumference q is provided with the distorted motif grid through a material-ablation process, especially through laser ablation.

43. The method according to claim 12, wherein step e) comprises embossing the distorted motif grid in an embossable lacquer layer.

44. The method according to claim 12, wherein step e) comprises imprinting the distorted motif grid on a substrate layer, especially on an optical spacing layer.

45. The method according to claim 13, wherein the vectors $\vec{u}_1$ and $\vec{u}_2$, and $\vec{w}_1$ and $\tilde{w}_2$ are modulated location-dependently, the local period parameters $|\vec{u}_1|, |\vec{u}_2|, \angle(\vec{u}_1, \vec{u}_2)$ and $|\vec{w}_1|, |\vec{w}_2|, \angle(\vec{w}_1, \vec{w}_2)$ changing only slowly in relation to the periodicity length.

46. The method according to claim 13, wherein the motif grid and the focusing element grid are arranged at opposing surfaces of an optical spacing layer.

47. The method according to claim 13, wherein step e) comprises providing an impression or embossing cylinder with the distorted focusing element grid.

48. The method according to claim 47, wherein, in step e), a flat plate is provided with the distorted focusing element grid, and the flat plate or a flat casting of the plate is fitted on an impression or embossing cylinder such that a cylinder having seams is created having a cylinder circumference q.

49. The method according to claim 47, wherein, in step e), a coated cylinder having a cylinder circumference q is provided with the distorted focusing element grid through a material-ablation process, especially through laser ablation.

50. The method according to claim 13, wherein step e) comprises embossing the distorted focusing element grid in an embossable lacquer layer.

51. The method according to claim 13, wherein step e) comprises providing an impression or embossing cylinder with the distorted motif grid.

52. The method according to claim 51, wherein, in step e), a flat plate is provided with the distorted motif grid, and the flat plate or a flat casting of the plate is fitted on an impression or embossing cylinder such that a cylinder having seams is created having a cylinder circumference q.

53. The method according to claim 51, wherein, in step e), a coated cylinder having a cylinder circumference q is provided with the distorted motif grid through a material-ablation process, especially through laser ablation.

54. The method according to claim 13, wherein step e) comprises embossing the distorted motif grid in an embossable lacquer layer.

55. The method according to claim 13, wherein step e) comprises imprinting the distorted motif grid on a substrate layer, especially on an optical spacing layer.

56. The method according to claim 14, wherein the vectors $\vec{u}_1$ and $\vec{u}_2$, and $\vec{w}_1$ and $\vec{w}_2$ are modulated location-dependently, the local period parameters $|\vec{u}_1|, |\vec{u}_2|, \angle(\vec{u}_1, \vec{u}_2)$ and $|\vec{w}_1|, |\vec{w}_2|, \angle(\vec{w}_1, \vec{w}_2)$ changing only slowly in relation to the periodicity length.

57. The method according to claim 14, wherein the motif grid and the focusing element grid are arranged at opposing surfaces of an optical spacing layer.

58. The method according to claim 14, wherein step e) comprises providing an impression or embossing cylinder with the distorted focusing element grid.

59. The method according to claim 58, wherein, in step e), a flat plate is provided with the distorted focusing element grid, and the flat plate or a flat casting of the plate is fitted on an impression or embossing cylinder such that a cylinder having seams is created having a cylinder circumference q.

60. The method according to claim 58, wherein, in step e), a coated cylinder having a cylinder circumference q is provided with the distorted focusing element grid through a material-ablation process, especially through laser ablation.

61. The method according to claim 14, wherein step e) comprises embossing the distorted focusing element grid in an embossable lacquer layer.

62. The method according to claim 14, wherein step e) comprises providing an impression or embossing cylinder with the distorted motif grid.

63. The method according to claim 62, wherein, in step e), a flat plate is provided with the distorted motif grid, and the flat plate or a flat casting of the plate is fitted on an impression or embossing cylinder such that a cylinder having seams is created having a cylinder circumference q.

64. The method according to claim 62, wherein, in step e), a coated cylinder having a cylinder circumference q is provided with the distorted motif grid through a material-ablation process, especially through laser ablation.

65. The method according to claim 14, wherein step e) comprises embossing the distorted motif grid in an embossable lacquer layer.

66. The method according to claim 14, wherein step e) comprises imprinting the distorted motif grid on a substrate layer, especially on an optical spacing layer.

* * * * *

UNITED STATES PATENT AND TRADEMARK OFFICE

CERTIFICATE OF CORRECTION

PATENT NO. : 8,783,728 B2
APPLICATION NO. : 12/601590
DATED : July 22, 2014
INVENTOR(S) : Wittich Kaule et al.

It is certified that error appears in the above-identified patent and that said Letters Patent is hereby corrected as shown below:

In the Claims

Column 29, Line 59, Claim 14, delete " $\vec{r} = \bar{A}^{-1} \cdot \bar{R} + \vec{r}_0$, " and insert -- $\vec{r} = \bar{A}^{-1} \cdot \bar{R} + \vec{r}_0$, --, Column 32, Line 5, Claim 45, delete " $\vec{w}_2$ " and insert -- $\vec{w}_2$ --.

Signed and Sealed this
Twenty-fifth Day of November, 2014

Michelle K. Lee

Michelle K. Lee
*Deputy Director of the United States Patent and Trademark Office*